US010975590B2

(12) United States Patent
Collins et al.

(10) Patent No.: US 10,975,590 B2
(45) **Date of Patent: *Apr. 13, 2021**

(54) DIAPHRAGM TO LATERAL SUPPORT COUPLING IN A STRUCTURE

(71) Applicant: Innovative Building Technologies, LLC, Seattle, WA (US)

(72) Inventors: Arlan Collins, Seattle, WA (US); Mark Woerman, Seattle, WA (US); Mark D'amato, Seattle, WA (US)

(73) Assignee: Innovative Building Technologies, LLC, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/368,642

(22) Filed: Mar. 28, 2019

(65) Prior Publication Data

US 2019/0218811 A1 Jul. 18, 2019

Related U.S. Application Data

(62) Division of application No. 15/507,678, filed as application No. PCT/US2014/053614 on Aug. 30, 2014, now Pat. No. 10,260,250.

(51) Int. Cl.

| | |
|---|---|
| ***E04H 9/02*** | (2006.01) |
| ***E04B 1/24*** | (2006.01) |
| ***E04B 1/26*** | (2006.01) |

(52) U.S. Cl.

CPC ..... *E04H 9/024* (2013.01); *E04B 1/2403* (2013.01); *E04B 1/2604* (2013.01); *E04H 9/021* (2013.01)

(58) Field of Classification Search

CPC ..... E04H 9/024; E04H 9/021; E04B 1/2403; E04B 1/2604

See application file for complete search history.

(56) References Cited

U.S. PATENT DOCUMENTS

| | | | |
|---|---|---|---|
| 1,168,556 | A | 1/1916 | Robinson et al. |
| 1,501,288 | A | 7/1924 | Morley |

(Continued)

FOREIGN PATENT DOCUMENTS

| | | |
|---|---|---|
| AU | 2005200682 | 5/2005 |
| AU | 201211472 | 2/2014 |

(Continued)

OTHER PUBLICATIONS

EPO, Communication Pursuant to Article 94(3) EPC mailed for EP application No. 15836516.3, dated Apr 25, 2019, 4 pages.

(Continued)

*Primary Examiner* — Rodney Mintz

(57) ABSTRACT

An example system is disclosed that may include a diaphragm, a pair of C-channels coupled to the diaphragm, a horizontal beam having two opposite ends, a pair of collars configured to slide onto the two opposite ends of the horizontal beam, the pair of collars each including a flange around a perimeter of each of the pair of collars, the flange configured to couple to an end of each of the pair of C-channels, a pair of columns coupled to the two opposite ends of the horizontal beam, and a brace coupled to at least one column of the pair of columns and the horizontal beam. An example method is disclosed for translating a lateral load from a diaphragm to a lateral load support system.

17 Claims, 12 Drawing Sheets

(56) References Cited

U.S. PATENT DOCUMENTS 1,876,528 A 7/1931 Walters
1,883,376 A 10/1932 George et al.
2,160,161 A 5/1939 Marsh
2,419,319 A 4/1947 Lankton
2,495,862 A 1/1950 Osborn
2,562,050 A 7/1951 Lankton
2,686,420 A 8/1954 Youtz
2,722,724 A 11/1955 Miller
2,758,467 A 8/1956 Brown et al.
2,871,544 A 2/1959 Youtz
2,871,997 A 2/1959 Simpson et al.
2,877,990 A 3/1959 Goemann
2,946,413 A 7/1960 Weismann
3,017,723 A 1/1962 Von Heidenstam
3,052,449 A 9/1962 Long et al.
3,053,015 A 9/1962 George
3,053,509 A 9/1962 Haupt et al.
3,065,575 A 11/1962 Ray
3,079,652 A 3/1963 Wahlfeld
3,090,164 A 5/1963 Nels
3,184,893 A 5/1965 Booth
3,221,454 A 12/1965 Togni
3,235,917 A 2/1966 Skubic
3,236,014 A 2/1966 Edgar
3,245,183 A 4/1966 Tessin
3,281,172 A 10/1966 Kuehl
3,315,424 A 4/1967 Smith
3,324,615 A 6/1967 Zinn
3,324,617 A 6/1967 Knight et al.
3,355,853 A 12/1967 Wallace
3,376,919 A 4/1968 Agostino
3,388,512 A 6/1968 Newman
3,392,497 A 7/1968 Vantine
3,411,252 A 11/1968 Boyle, Jr.
3,460,302 A 8/1969 Cooper
3,469,873 A 9/1969 Glaros
3,490,191 A 1/1970 Ekblom
3,533,205 A 10/1970 Pestel et al.
3,568,380 A 3/1971 Stucky et al.
3,579,935 A 5/1971 Regan et al.
3,590,393 A 7/1971 Hollander
3,594,965 A 7/1971 Saether
3,601,937 A 8/1971 Campbell
3,604,174 A 9/1971 Nelson, Jr.
3,608,258 A 9/1971 Spratt
3,614,803 A 10/1971 Matthews
3,638,380 A 2/1972 Perri
3,707,165 A 12/1972 Stahl
3,713,265 A 1/1973 Wysocki et al.
3,721,056 A 3/1973 Toan
3,722,169 A 3/1973 Boehmig
3,727,753 A 4/1973 Starr
3,742,666 A 7/1973 Antoniou
3,750,366 A 8/1973 Rich, Jr. et al.
3,751,864 A 8/1973 Berger et al.
3,755,974 A 9/1973 Berman
3,762,115 A 10/1973 McCaul, III
3,766,574 A 10/1973 Smid, Jr.
3,821,818 A 7/1974 Alosi
3,823,520 A 7/1974 Ohta et al.
3,845,601 A 11/1974 Kostecky
3,853,452 A 12/1974 Delmonte
3,885,367 A 5/1975 Thunberg
3,906,686 A 9/1975 Dillon
3,921,362 A 11/1975 Ortega
3,926,486 A 12/1975 Sasnett
3,971,605 A 7/1976 Sasnett
3,974,618 A 8/1976 Cortina
3,990,202 A 11/1976 Becker
4,018,020 A 4/1977 Sauer et al.
4,038,796 A 8/1977 Eckel
4,050,215 A 9/1977 Fisher
4,059,936 A 11/1977 Lukens
4,065,905 A 1/1978 Lely et al.
4,078,345 A 3/1978 Piazzalunga
4,107,886 A 8/1978 Ray
4,112,173 A 9/1978 Roudebush
4,114,335 A 9/1978 Carroll
4,142,255 A 3/1979 Togni
4,161,087 A 7/1979 Levesque
4,170,858 A 10/1979 Walker
4,171,545 A 10/1979 Kann
4,176,504 A 12/1979 Huggins
4,178,343 A 12/1979 Rojo, Jr.
4,205,719 A 6/1980 Norell et al.
4,206,162 A 6/1980 Vanderklaauw
4,214,413 A 7/1980 Gonzalez Espinosa de Los Monteros
4,221,441 A 9/1980 Bain
4,226,061 A 10/1980 Day, Jr.
4,227,360 A 10/1980 Balinski
4,248,020 A 2/1981 Zielinski et al.
4,251,974 A 2/1981 Vanderklaauw
4,280,307 A 7/1981 Griffin
4,314,430 A 2/1982 Farrington
4,325,205 A 4/1982 Salim
4,327,529 A 5/1982 Bigelow, Jr.
4,341,052 A 7/1982 Douglass, Jr.
4,361,994 A 12/1982 Carver
4,389,831 A 6/1983 Baumann
4,397,127 A 8/1983 Mieyal
4,435,927 A 3/1984 Umezu
4,441,286 A 4/1984 Skvaril
4,447,987 A 5/1984 Lesosky
4,447,996 A 5/1984 Maurer, Jr.
4,477,934 A 10/1984 Salminen
4,507,901 A 4/1985 Carroll
4,513,545 A 4/1985 Hopkins, Jr.
4,528,793 A 7/1985 Johnson
4,531,336 A 7/1985 Gartner
4,592,175 A 6/1986 Werner
4,646,495 A 3/1987 Chalik
4,648,228 A 3/1987 Kiselewski
4,655,011 A 4/1987 Borges
4,688,750 A 8/1987 Teague et al.
4,712,352 A 12/1987 Low
4,757,663 A 7/1988 Kuhr
4,813,193 A 3/1989 Altizer
4,856,244 A 8/1989 Clapp
4,862,663 A 9/1989 Krieger
4,893,435 A 1/1990 Shalit
4,910,932 A 3/1990 Honigman
4,918,897 A 4/1990 Luedtke
4,919,164 A 4/1990 Barenburg
4,974,366 A 12/1990 Tizzoni
4,991,368 A 2/1991 Amstutz
5,009,043 A 4/1991 Kurrasch
5,010,690 A 4/1991 Geoffrey
5,036,638 A 8/1991 Kurtz, Jr.
5,076,310 A 12/1991 Barenburg
5,079,890 A 1/1992 Kubik et al.
5,127,203 A 7/1992 Paquette
5,127,760 A 7/1992 Brady
5,154,029 A 10/1992 Sturgeon
5,185,971 A 2/1993 Johnson, Jr.
5,205,091 A 4/1993 Brown
5,212,921 A 5/1993 Unruh
5,228,254 A 7/1993 Honeycutt, Jr.
5,233,810 A 8/1993 Jennings
5,254,203 A 10/1993 Corston
5,307,600 A 5/1994 Simon, Jr. et al.
5,359,816 A * 11/1994 Iacouides ..... E04B 1/0007 52/236.7
5,359,820 A 11/1994 McKay
5,361,556 A 11/1994 Menchetti
5,402,612 A 4/1995 diGirolamo et al.
5,412,913 A 5/1995 Daniels et al.
5,426,894 A 6/1995 Headrick
5,452,552 A 9/1995 Ting
5,459,966 A 10/1995 Suarez
5,471,804 A 12/1995 Winter, IV
5,483,773 A 1/1996 Parisien
5,493,838 A 2/1996 Ross
5,509,242 A 4/1996 Rechsteiner et al.

(56) References Cited

U.S. PATENT DOCUMENTS 5,519,971 A 5/1996 Ramirez
5,528,877 A 6/1996 Franklin
5,531,539 A 7/1996 Crawford
5,584,142 A 12/1996 Spiess
5,592,796 A 1/1997 Landers
5,593,115 A 1/1997 Lewis
5,611,173 A 3/1997 Headrick et al.
5,628,158 A 5/1997 Porter
5,640,824 A 6/1997 Johnson
5,660,017 A 8/1997 Houghton
5,678,384 A 10/1997 Maze
5,697,189 A 12/1997 Miller
5,699,643 A 12/1997 Kinard
5,706,607 A 1/1998 Frey
5,724,773 A 3/1998 Hall
5,735,100 A 4/1998 Campbell
5,743,330 A 4/1998 Bilotta et al.
5,746,034 A 5/1998 Luchetti et al.
5,755,982 A 5/1998 Strickland
5,850,686 A 12/1998 Mertes
5,867,964 A 2/1999 Perrin
5,870,867 A 2/1999 Mitchell
5,921,041 A 7/1999 Egri, II
5,970,680 A 10/1999 Powers
5,987,841 A 11/1999 Campo
5,992,109 A 11/1999 Jonker
5,997,792 A 12/1999 Gordon
6,000,194 A 12/1999 Nakamura
6,055,787 A 5/2000 Gerhaher et al.
6,073,401 A 6/2000 Iri et al.
6,073,413 A 6/2000 Tongiatama
6,076,319 A 6/2000 Hendershot
6,086,350 A 7/2000 Del Monte
6,128,877 A 10/2000 Goodman et al.
6,151,851 A * 11/2000 Carter ..... E04B 1/24 52/236.3
6,154,774 A 11/2000 Furlong
6,170,214 B1 1/2001 Treister et al.
6,199,336 B1 3/2001 Poliquin
6,240,704 B1 6/2001 Porter
6,243,993 B1 6/2001 Swensson
6,244,002 B1 6/2001 Martin
6,244,008 B1 6/2001 Miller
6,260,329 B1 7/2001 Mills
6,289,646 B1 9/2001 Watanabe
6,301,838 B1 10/2001 Hall
6,308,465 B1 10/2001 Galloway et al.
6,308,491 B1 10/2001 Porter
6,340,508 B1 1/2002 Frommelt
6,371,188 B1 4/2002 Baczuk
6,393,774 B1 5/2002 Fisher
6,421,968 B2 7/2002 Degelsegger
6,427,407 B1 8/2002 Wilson
6,430,883 B1 8/2002 Paz et al.
6,446,396 B1 9/2002 Marangoni et al.
6,481,172 B1 11/2002 Porter
6,484,460 B2 11/2002 VanHaitsma
6,571,523 B2 6/2003 Chambers
6,625,937 B1 9/2003 Parker
6,651,393 B2 11/2003 Don
6,688,056 B2 2/2004 Von Hoyningen Huene et al.
6,729,094 B1 5/2004 Spencer et al.
6,748,709 B1 6/2004 Sherman et al.
6,807,790 B2 * 10/2004 Strickland ..... E04B 5/32 52/204.2
6,837,013 B2 1/2005 Foderberg et al.
6,922,960 B2 8/2005 Sataka
6,935,079 B1 8/2005 Julian et al.
6,964,410 B1 11/2005 Hansen
7,007,343 B2 3/2006 Weiland
7,059,017 B1 6/2006 Rosko
7,143,555 B2 12/2006 Miller
RE39,462 E 1/2007 Brady
7,389,620 B1 6/2008 McManus
7,395,999 B2 7/2008 Walpole
7,444,793 B2 11/2008 Raftery et al.
7,467,469 B2 12/2008 Wall
7,484,329 B2 2/2009 Fiehler
7,484,339 B2 2/2009 Fiehler
7,493,729 B1 2/2009 Semmes
7,546,715 B2 6/2009 Roen
7,574,837 B2 8/2009 Hagen, Jr. et al.
7,640,702 B2 * 1/2010 Termohlen ..... E04B 5/43 52/280
7,658,045 B2 2/2010 Elliott et al.
7,676,998 B2 3/2010 Lessard
7,694,462 B2 4/2010 O'Callaghan
7,721,491 B2 5/2010 Appel
7,748,193 B2 7/2010 Knigge et al.
7,908,810 B2 3/2011 Payne, Jr. et al.
7,921,965 B1 4/2011 Surace
7,941,985 B2 * 5/2011 Simmons ..... E04B 1/24 52/655.1
7,966,778 B2 6/2011 Klein
8,051,623 B2 11/2011 Loyd
D652,956 S 1/2012 Tanaka et al.
8,096,084 B2 1/2012 Studebaker et al.
8,109,058 B2 2/2012 Miller
8,127,507 B1 3/2012 Bilge
8,166,716 B2 5/2012 Macdonald et al.
8,234,827 B1 8/2012 Schroeder, Sr.
8,234,833 B2 8/2012 Miller
8,251,175 B1 8/2012 Englert et al.
8,276,328 B2 10/2012 Pépin
8,322,086 B2 12/2012 Weber
8,359,808 B2 1/2013 Stephens, Jr.
8,424,251 B2 4/2013 Tinianov
8,490,349 B2 7/2013 Lutzner
8,505,259 B1 8/2013 Degtyarev
8,539,732 B2 9/2013 Leahy
8,555,581 B2 10/2013 Amend
8,555,589 B2 10/2013 Semmens et al.
8,555,598 B2 10/2013 Wagner et al.
8,621,806 B2 1/2014 Studebaker et al.
8,621,818 B1 1/2014 Glenn et al.
8,631,616 B2 1/2014 Carrion et al.
8,733,046 B2 5/2014 Naidoo
8,769,891 B2 7/2014 Kelly
8,826,613 B1 9/2014 Chrien
8,833,025 B2 9/2014 Krause
8,950,132 B2 2/2015 Collins et al.
8,966,845 B1 3/2015 Ciuperca
8,978,324 B2 3/2015 Collins et al.
8,991,111 B1 3/2015 Harkins
8,997,424 B1 4/2015 Miller
9,027,307 B2 5/2015 Collins et al.
9,382,709 B2 7/2016 Collins et al.
9,637,911 B2 * 5/2017 Doupe ..... E04B 1/2604
9,683,361 B2 6/2017 Timberlake et al.
10,041,289 B2 8/2018 Collins et al.
10,260,250 B2 * 4/2019 Collins ..... E04H 9/024
10,273,686 B2 * 4/2019 Lake ..... E04B 1/7612
10,323,428 B2 6/2019 Collins et al.
10,370,851 B2 8/2019 Bodwell et al.
10,501,929 B2 * 12/2019 Henry ..... E04B 1/24 52/236.8
10,731,330 B2 * 8/2020 Petricca ..... E04H 6/08
2002/0059763 A1 5/2002 Wong
2002/0092703 A1 7/2002 Gelin et al.
2002/0134036 A1 9/2002 Daudet et al.
2002/0170243 A1 11/2002 Don
2002/0184836 A1 12/2002 Takeuchi et al.
2003/0005653 A1 1/2003 Sataka
2003/0056445 A1 3/2003 Cox
2003/0084629 A1 5/2003 Strickland et al.
2003/0101680 A1 6/2003 Lee
2003/0140571 A1 7/2003 Muha et al.
2003/0167712 A1 9/2003 Robertson
2003/0167719 A1 9/2003 Alderman
2003/0200706 A1 10/2003 Kahan et al.
2003/0221381 A1 12/2003 Ting
2004/0065036 A1 4/2004 Capozzo
2004/0103596 A1 6/2004 Don
2004/0221518 A1 11/2004 Westra

(56) References Cited

U.S. PATENT DOCUMENTS

2005/0081484 A1 4/2005 Yland
2005/0108957 A1 5/2005 Quesada
2005/0188626 A1 9/2005 Johnson
2005/0188632 A1 9/2005 Rosen
2005/0198919 A1 9/2005 Hester, Jr.
2005/0204697 A1 9/2005 Rue
2005/0204699 A1 9/2005 Rue
2005/0210764 A1 9/2005 Foucher et al.
2005/0210798 A1 9/2005 Burg et al.
2005/0235571 A1 10/2005 Ewing et al.
2005/0235581 A1 10/2005 Cohen
2005/0247013 A1 11/2005 Walpole
2005/0262771 A1 12/2005 Gorman
2006/0021289 A1 2/2006 Elmer
2006/0070321 A1 4/2006 Au
2006/0090326 A1 5/2006 Corbett
2006/0096202 A1 5/2006 Delzotto
2006/0117689 A1 6/2006 Onken et al.
2006/0137293 A1 6/2006 Klein
2006/0143856 A1 7/2006 Rosko et al.
2006/0150521 A1 7/2006 Henry
2006/0179764 A1 8/2006 Ito
2006/0248825 A1 11/2006 Garringer
2006/0277841 A1 12/2006 Majusiak
2007/0000198 A1 1/2007 Payne
2007/0074464 A1 4/2007 Eldridge
2007/0107349 A1 5/2007 Erker
2007/0151196 A1 7/2007 Boatwright
2007/0157539 A1 7/2007 Knigge et al.
2007/0163197 A1 7/2007 Payne et al.
2007/0209306 A1 9/2007 Andrews et al.
2007/0234657 A1 10/2007 Speyer et al.
2007/0251168 A1 11/2007 Turner
2007/0283640 A1 12/2007 Shivak et al.
2007/0294954 A1 12/2007 Barrett
2008/0000177 A1 1/2008 Siu
2008/0057290 A1 3/2008 Guevara et al.
2008/0092472 A1 4/2008 Doerr et al.
2008/0098676 A1 5/2008 Hutchens
2008/0099283 A1 5/2008 Reigwein
2008/0104901 A1 5/2008 Olvera
2008/0168741 A1 7/2008 Gilgan
2008/0178542 A1 7/2008 Williams
2008/0190053 A1 8/2008 Surowiecki
2008/0202048 A1 8/2008 Miller et al.
2008/0222981 A1 9/2008 Gobbi
2008/0229669 A1 9/2008 Abdollahzadeh et al.
2008/0245007 A1 9/2008 McDonald
2008/0279620 A1* 11/2008 Berg ..... F16B 7/042 403/178
2008/0282626 A1 11/2008 Powers, Jr.
2008/0289265 A1 11/2008 Lessard
2008/0295443 A1* 12/2008 Simmons ..... E04B 1/24 52/655.1
2008/0295450 A1 12/2008 Yogev
2009/0031652 A1 2/2009 Ortega Gatalan
2009/0038764 A1 2/2009 Pilz
2009/0064611 A1 3/2009 Hall et al.
2009/0077916 A1 3/2009 Scuderi et al.
2009/0090074 A1 4/2009 Klein
2009/0100760 A1 4/2009 Ewing
2009/0100769 A1 4/2009 Barrett
2009/0100796 A1* 4/2009 Denn ..... E04B 1/18 52/849
2009/0107065 A1 4/2009 LeBlang
2009/0113820 A1 5/2009 Deans
2009/0134287 A1 5/2009 Klosowski
2009/0165399 A1 7/2009 Campos Gines
2009/0188192 A1 7/2009 Studebaker et al.
2009/0188193 A1 7/2009 Studebaker et al.
2009/0205277 A1 8/2009 Gibson
2009/0249714 A1 10/2009 Combs et al.
2009/0277122 A1 11/2009 Howery et al.
2009/0282766 A1 11/2009 Roen
2009/0283359 A1 11/2009 Ravnaas
2009/0293395 A1 12/2009 Porter
2009/0313931 A1 12/2009 Porter
2010/0050556 A1 3/2010 Burns
2010/0058686 A1 3/2010 Henriquez
2010/0064590 A1 3/2010 Jones et al.
2010/0064601 A1 3/2010 Napier
2010/0146874 A1 6/2010 Brown
2010/0146893 A1 6/2010 Dickinson
2010/0186313 A1 7/2010 Stanford et al.
2010/0212255 A1 8/2010 Lesoine
2010/0218443 A1 9/2010 Studebaker
2010/0229472 A1 9/2010 Malpas
2010/0235206 A1 9/2010 Miller et al.
2010/0263308 A1 10/2010 Olvera
2010/0275544 A1 11/2010 Studebaker et al.
2010/0313518 A1* 12/2010 Berg ..... E04B 1/215 52/707
2010/0325971 A1 12/2010 Leahy
2010/0325989 A1 12/2010 Leahy
2011/0023381 A1 2/2011 Weber
2011/0041411 A1 2/2011 Aragon
2011/0056147 A1 3/2011 Beaudet
2011/0113709 A1 5/2011 Pilz
2011/0113715 A1 5/2011 Tonyan et al.
2011/0126484 A1 6/2011 Carrion et al.
2011/0146180 A1 6/2011 Klein et al.
2011/0154766 A1 6/2011 Kralic et al.
2011/0162167 A1 7/2011 Blais
2011/0219720 A1 9/2011 Strickland et al.
2011/0247281 A1 10/2011 Pilz et al.
2011/0268916 A1 11/2011 Pardue, Jr.
2011/0296769 A1 12/2011 Collins et al.
2011/0296778 A1 12/2011 Collins et al.
2011/0296789 A1 12/2011 Collins et al.
2011/0300386 A1 12/2011 Pardue, Jr.
2012/0073227 A1 3/2012 Urusoglu
2012/0096800 A1* 4/2012 Berg ..... E04B 1/003 52/588.1
2012/0137610 A1 6/2012 Knight et al.
2012/0151869 A1 6/2012 Miller
2012/0167505 A1 7/2012 Krause
2012/0186174 A1 7/2012 LeBlang
2012/0210658 A1 8/2012 Logan
2012/0291378 A1* 11/2012 Schroeder, Sr. ..... E04B 1/24 52/236.8
2012/0297712 A1 11/2012 Lutzner et al.
2012/0317923 A1 12/2012 Herdt et al.
2013/0025222 A1 1/2013 Mueller
2013/0025966 A1 1/2013 Nam et al.
2013/0036688 A1 2/2013 Gosain
2013/0067832 A1 3/2013 Collins et al.
2013/0111840 A1 5/2013 Bordener
2013/0133277 A1 5/2013 Lewis
2013/0232887 A1 9/2013 Donnini
2014/0013678 A1 1/2014 Deverini
2014/0013684 A1 1/2014 Kelly et al.
2014/0013695 A1 1/2014 Wolynski et al.
2014/0047780 A1 2/2014 Quinn et al.
2014/0059960 A1 3/2014 Cole
2014/0069035 A1 3/2014 Collins et al.
2014/0069040 A1 3/2014 Gibson
2014/0069050 A1 3/2014 Bolin
2014/0083046 A1 3/2014 Yang
2014/0090323 A1 4/2014 Glancy
2014/0130441 A1 5/2014 Sugihara et al.
2014/0317841 A1 10/2014 Dejesus et al.
2014/0338280 A1* 11/2014 Tanaka ..... E04B 1/2403 52/655.1
2015/0007415 A1 1/2015 Kalinowski
2015/0093184 A1* 4/2015 Henry ..... E04B 1/2604 403/187
2015/0096251 A1 4/2015 McCandless et al.
2015/0121797 A1* 5/2015 Brown ..... E04B 1/483 52/699
2015/0128518 A1 5/2015 Knight et al.
2015/0136361 A1 5/2015 Gregory
2015/0152634 A1 6/2015 Unger
2015/0211227 A1 7/2015 Collins et al.
2015/0233108 A1 8/2015 Eggleston, II et al.

(56) References Cited

U.S. PATENT DOCUMENTS

| | | | | |
|---|---|---|---|---|
| 2015/0252558 | A1 | 9/2015 | Chin | |
| 2015/0284950 | A1 | 10/2015 | Stramandinoli | |
| 2015/0297926 | A1 | 10/2015 | Dzegan | |
| 2015/0308096 | A1 | 10/2015 | Merhi et al. | |
| 2016/0002912 | A1* | 1/2016 | Doupe | E04B 1/2604 52/702 |
| 2016/0053475 | A1 | 2/2016 | Locker et al. | |
| 2016/0122996 | A1 | 5/2016 | Timberlake et al. | |
| 2016/0145933 | A1 | 5/2016 | Condon et al. | |
| 2016/0258160 | A1 | 9/2016 | Radhouane et al. | |
| 2016/0290030 | A1 | 10/2016 | Collins et al. | |
| 2016/0319534 | A1 | 11/2016 | Bernardo | |
| 2017/0037613 | A1 | 2/2017 | Collins et al. | |
| 2017/0284095 | A1 | 10/2017 | Collins et al. | |
| 2017/0299198 | A1 | 10/2017 | Collins et al. | |
| 2017/0306624 | A1 | 10/2017 | Graham et al. | |
| 2017/0306625 | A1 | 10/2017 | Collins et al. | |
| 2017/0342735 | A1* | 11/2017 | Collins | E04H 9/024 |
| 2018/0038103 | A1 | 2/2018 | Neumayr | |
| 2018/0148926 | A1* | 5/2018 | Lake | E04B 2/967 |
| 2018/0209136 | A1 | 7/2018 | Aylward et al. | |
| 2018/0223521 | A1* | 8/2018 | Uno | E04B 1/215 |
| 2018/0328056 | A1 | 11/2018 | Collins et al. | |
| 2019/0032327 | A1 | 3/2019 | Musson | |
| 2019/0119908 | A1* | 4/2019 | Petricca | E04B 1/4114 |
| 2019/0136508 | A1 | 5/2019 | Chaillan | |
| 2019/0249409 | A1* | 8/2019 | Boyd | E04B 1/1912 |
| 2020/0224407 | A1* | 7/2020 | Ng | F24S 25/65 |

FOREIGN PATENT DOCUMENTS

| | | | |
|---|---|---|---|
| AU | 2012211472 | | 2/2014 |
| CN | 1313921 | | 9/2001 |
| CN | 1234087 | | 11/2002 |
| CN | 1742144 | | 3/2006 |
| CN | 02137279 | | 3/2008 |
| CN | 20137279 | | 3/2008 |
| CN | 101426986 | | 5/2009 |
| CN | 101821462 | | 9/2010 |
| CN | 101831963 | | 9/2010 |
| CN | 102105642 | | 6/2011 |
| CN | 201952944 | | 8/2011 |
| CN | 202117202 | | 1/2012 |
| CN | 102459775 | | 5/2012 |
| CN | 102587693 | | 7/2012 |
| CN | 202299241 | | 7/2012 |
| CN | 202391078 | | 8/2012 |
| CN | 102733511 | | 10/2012 |
| CN | 205024886 | | 2/2016 |
| CN | 206070835 | | 4/2017 |
| CN | 108487464 | A * | 9/2018 |
| DE | 4205812 | | 9/1993 |
| DE | 9419429 | | 2/1995 |
| DE | 20002775 | | 8/2000 |
| DE | 19918153 | | 11/2000 |
| DE | 20315506 | | 11/2004 |
| DE | 202008007139 | | 10/2009 |
| EP | 0612896 | | 8/1994 |
| EP | 1045078 | | 10/2000 |
| EP | 0235029 | | 2/2002 |
| EP | 1375804 | | 1/2004 |
| EP | 1568828 | | 8/2005 |
| EP | 2128353 | | 12/2009 |
| EP | 2213808 | | 8/2010 |
| EP | 2238872 | | 10/2010 |
| EP | 1739246 | | 1/2011 |
| EP | 2281964 | | 2/2011 |
| EP | 3133220 | | 2/2017 |
| FR | 1317681 | | 5/1963 |
| FR | 2988749 | | 10/2013 |
| FR | 2765906 | | 1/2019 |
| GB | 898905 | | 6/1962 |
| GB | 2481126 | | 12/2011 |
| JP | S46-006980 | | 12/1971 |
| JP | S49-104111 | | 9/1974 |
| JP | 52-015934 | | 4/1977 |
| JP | 53-000014 | | 1/1978 |
| JP | 53-156364 | | 12/1978 |
| JP | S54-084112 | | 6/1979 |
| JP | S54-145910 | | 11/1979 |
| JP | 56-131749 | | 10/1981 |
| JP | 57-158451 | | 9/1982 |
| JP | S59-065126 | | 5/1984 |
| JP | S60-019606 | | 2/1985 |
| JP | 61-144151 | | 9/1986 |
| JP | S61-201407 | | 12/1986 |
| JP | 63058035 | A * | 3/1988 |
| JP | H01-153013 | | 10/1989 |
| JP | H0130985 | | 1/1991 |
| JP | H0310985 | | 1/1991 |
| JP | H049373 | | 3/1992 |
| JP | 6-12178 | | 2/1994 |
| JP | 06-212721 | | 8/1994 |
| JP | H06220932 | | 8/1994 |
| JP | H07-173893 | | 7/1995 |
| JP | H0752887 | | 12/1995 |
| JP | 8-189078 | | 7/1996 |
| JP | H08189078 | | 7/1996 |
| JP | H09228510 | | 9/1997 |
| JP | 2576409 | Y2 | 7/1998 |
| JP | 10234493 | | 9/1998 |
| JP | H10245918 | | 9/1998 |
| JP | 11-117429 | | 4/1999 |
| JP | H11-100926 | | 4/1999 |
| JP | 2000-34801 | | 2/2000 |
| JP | 2000144997 | | 5/2000 |
| JP | 2000-160861 | | 6/2000 |
| JP | 3137760 | | 2/2001 |
| JP | 3257111 | | 2/2002 |
| JP | 2002-309691 | | 10/2002 |
| JP | 2002536615 | | 10/2002 |
| JP | 2002364104 | | 12/2002 |
| JP | 2003-505624 | | 2/2003 |
| JP | 2003-278300 | | 10/2003 |
| JP | 2003-293493 | | 10/2003 |
| JP | 2003278300 | | 10/2003 |
| JP | 2004108031 | | 4/2004 |
| JP | 2004-344194 | | 12/2004 |
| JP | 3664280 | | 6/2005 |
| JP | 2006-161406 | | 6/2006 |
| JP | 3940621 | | 7/2007 |
| JP | 3137760 | | 12/2007 |
| JP | 2008-063753 | | 3/2008 |
| JP | 2008073434 | | 4/2008 |
| JP | 2008110104 | | 5/2008 |
| JP | 2009-257713 | | 11/2009 |
| JP | 2010-185264 | | 8/2010 |
| JP | 2010185264 | | 8/2010 |
| JP | 2010245918 | | 10/2010 |
| JP | 2011-032802 | | 2/2011 |
| JP | 3187449 | | 11/2013 |
| JP | 2015-117502 | | 6/2015 |
| KR | 1019990052255 | | 7/1999 |
| KR | 1019990053902 | | 7/1999 |
| KR | 100236196 | | 12/1999 |
| KR | 102000200413000 | | 10/2000 |
| KR | 20060066931 | | 6/2006 |
| KR | 20080003326 | | 8/2008 |
| KR | 101481790 | | 1/2015 |
| KR | 20180092677 | | 8/2018 |
| WO | 9107557 | | 5/1991 |
| WO | 1991007557 | | 5/1991 |
| WO | 1997022770 | | 6/1997 |
| WO | 200046457 | | 8/2000 |
| WO | 0058583 | | 10/2000 |
| WO | 2002/035029 | | 5/2002 |
| WO | 0235029 | | 5/2002 |
| WO | 2002035029 | | 5/2002 |
| WO | 2006/091864 | | 8/2006 |
| WO | 2007059003 | | 5/2007 |
| WO | 2007/080561 | | 7/2007 |
| WO | 2008/113207 | | 9/2008 |
| WO | 2010030060 | | 3/2010 |

(56) References Cited

FOREIGN PATENT DOCUMENTS

| | | |
|---|---|---|
| WO | 2010037938 | 4/2010 |
| WO | 2011/015681 | 2/2011 |
| WO | 2011/116622 | 9/2011 |
| WO | 2015050502 | 4/2015 |
| WO | 2016032537 | 3/2016 |
| WO | 2016032538 | 3/2016 |
| WO | 2016032539 | 3/2016 |
| WO | 2016032540 | 3/2016 |
| WO | 2016033429 | 3/2016 |
| WO | 2016033525 | 3/2016 |

OTHER PUBLICATIONS

EPO, Extended European Search Report for European Patent Application No. 17763913.5, dated Oct. 16, 2019, 8 pages.
EPO, Partial European Search Report for European Patent Application No. 17763910.1, dated Oct. 17, 2019, 16 pages.
EPO, Extended European Search Report for European Patent Application No. 17763907.7, dated Sep. 13, 2019, 13 pages.
WIPO, International Search Report and Written Opinion for PCT Application No. PCT/US2019/038557, dated Sep. 4, 2019, 67 pages.
WIPO, International Search Report and Written Opinion mailed for International application No. PCT/US2019/031370, dated Aug 7, 2019, 11 pages.
EPO, Extended European Search Report for European Patent Application No. 17763914.3, dated Nov. 19, 2019, 10 pages.
EPO, Communication Pursuant to Article 94(3) EPC mailed for European patent application No. 14900469.9, dated Jun. 18, 2019, 5 pages.
WIPO, International Search Report for International Patent Application No. PCT/US2017/021174, dated Jun. 26, 2017, 11 pages.
WIPO, Written Opinion for International Patent Application No. PCT/US2017/021174, dated Jun. 26, 2017, 6 pages.
WIPO, International Search Report of International Patent Application No. PCT/US2017/021177, dated Jun. 5, 2017, 8 pages.
WIPO, Written Opinion of International Patent Application No. PCT/US2017/021177, dated Jun. 5, 2017, 8 pages.
WIPO, International Search Report for International Patent Application No. PCT/US2017/021168, dated May 19, 2017, 5 pages.
WIPO, Written Opinion for International Patent Application No. PCT/US2017/021168, dated May 19, 2017, 8 pages.
WIPO, International Search Report for International Patent Application No. PCT/US2017/021179, dated May 25, 2017, 7 pages.
WIPO, Written Opinion for International Patent Application No. PCT/US2017/021179, dated May 25, 2017, 7 pages.
EPO, Communication Pursuant to Article 94(3) EPC mailed for European patent application No. 15836516.3, dated Aug. 2, 2019, 4 pages.
U.S. Appl. No. 12/796,603, dated Jun. 8, 2010, Collins et al.
International Search Report and Written opinion for International Application No. PCT/US/2014/053614 dated Dec. 18, 2014, 11 pages.
International Search Report and Written opinion for International Application No. PCT/US/2014/053615 dated Dec. 17, 2014, 11 pages.
International Search Report and Written opinion for International Application No. PCT/US/2014/053613 dated Dec. 18, 2014, 13 Pages.
International Search Report and Written Opinion for International Application No. PCT/US2011/001039 dated Oct. 5, 2011, 14 Pages.
International Search Report and Written opinion for International Application No. PCT/US2015/047383 dated Jan. 12, 2016, 14 Pages.
International Search Report and Written opinion for International Application No. PCT/US15/47536 dated Dec. 4, 2015, 17 Pages.
International Search Report and Written opinion for International Application No. PCT/US/2014/053616 dated Dec. 17, 2014, 9 Pages.
International Search Report and Written Opinion for PCT Application No. PCT/US2011/001039 dated Oct. 5, 2011, 9 Pages.
"Beam to column connection", TATA Steel, http://www.tatasteelconstruction.com/en/reference/teaching_resources/architectural_studio_reference/elements/connections/beam to column connections, 2014, 4 Pages.
"Emerging Trends 2012 Executive Summary", Urban Land Institute, Ch. 1, 2011, 1-11 Pages.
"Emerging Trends in real estate", accessed on Sep. 15, 2016 at https://web.archive.orglweb120140813084823/http://pwc.corn.au/industry/real-estate/assets/Real-Estate-2012-Europe-Jan12.pdf, 2012, 60 Pages.
"How to Soundproof a Ceiling—Soundproofing Ceilings", http://www.soundproofingcompany.com/soundproofing-solutions/soundproof-a-ceiling/, Apr. 2, 2014, 1-7 Pages.
"Insulspan Installation Guide", Obtained at: http://www.insuispan.comidownloads:InstallationGuide,pdf on Feb. 2, 2016, 58 pages.
"Structural Insulated Panel", Wikipedia, http://www.en.wikipedia.org//wiki/Structural_insulated_panel, May 30, 2014, 5 Pages.
"Structural Insulated Panels", SIP Solutions, http://www.sipsolutions.com/content/structuralinsulated-panels, Aug. 15, 2014, 3 pages.
"US Apartment & Condominium Construction Forecast 2003-2017", Statista, Inc., Jun. 2012, 8 Pages.
Azari, et al., "Modular Prefabricated Residential Construction—Constraints and Opportunities", PNCCRE Technical Report #TR002, Aug. 2013, 90 Pages.
Borzouie, Jamaledin, et al., "Seismic Assesment and Reahbilitation of Diaphragms", http://www.nosazimadares.ir/behsazi/15WCEE2012/URM/1/Roof.pdf, Dec. 31, 2011, 86 Pages.
Framecad, "FC EW 1-12mm Fibre Cement Sheet + 9mm MgO Board Wall Assembly", 2013, 2 Pages.
Giles, et al., "Innovations in the Development of Industrially Designed and Manufactured Modular Concepts for Low-Energy, Multi-Story, High Density, Prefabricated Affordable Housing", Innovations in the Development of Industrially Designed and Manufactured Modular Concepts, 2006, 1-15 Pages.
Gonchar, "Paradigm Shift—Multistory Modular", Architectural Record, Oct. 2012, 144-148 Pages.
Kerin, et al., "National Apartment Market Report—2013", Marcus & Millichap, 2013, 1-9 pages.
M.A. Riusillo, "Lift Slab Construction: Its History, Methodology, Economics and Applications", ACI-Abstract, Jun. 1, 1988, 2 pages.
McIlwain, "Housing in America—The Next Decade", Urban Land Institute, 2010, 1-28 Pages.
McIlwain, "The Rental Boost From Green Design", Urban Land, http://urbanland.uli.org/sustainability/the-rental-boost-from-green-design/, Jan. 4, 2012, 1-6 Pages.
Shashaty, Andre, "Housing Demand", Sustainable Communities, Apr. 2011, 14-18 Pages.
Sichelman, "Severe Apartment Shortage Looms", Urban Land, http://urbanland.uli.org/capital-markets/nahb-orlando-severe-apartmentshortage-looms/, Jan. 13, 2011, 1-2 Pages.
Stiemer, S F, "Bolted Beam-Column Connections", http://faculty.philau.edu/pastorec/Tensile/bolted_beam_column_connections.pdf, Nov. 11, 2007, 1-16 Pages.
Extended European Search Report for European Patent Application No. 14900469, dated Mar. 20, 2018, 1-8 pages.
Extended European Search Report for European Application No. EP 15836516.3, dated Jun. 22, 2018, 1-5 pages.
European Search Report received for POT 14891125.8-1604/3011122 dated Jul. 8, 2016, 4 pages.
European Search Report in PCT/US2015/047383 dated Jun. 22, 2018, 10 pages.
EPO, Extended European Search Report for European Patent Application No. 17763910.1, dated Jan. 28, 2020, 13 pages.

* cited by examiner

1000

1100

DIAPHRAGM TO LATERAL SUPPORT COUPLING IN A STRUCTURE

CROSS-REFERENCE TO RELATED APPLICATIONS

This application is a continuation application under 35 U.S.C. § 120 of U.S. application Ser. No. 15/507,678, filed on Feb. 28, 2017, now U.S. Pat. No. 10,260,250, which is a U.S. national stage filing under 35 U.S.C. § 371 of International Application No. PCT/US2014/053614, filed on Aug. 30, 2014. The disclosures of U.S. application Ser. No. 15/507,678 and International Application No. PCT/US2014/053614 are incorporated herein by reference in their entirety.

BACKGROUND

Buildings may include a variety of support systems to withstand different forces applied to the building. For example, vertical load systems cope with forces placed upon a structure by gravity while lateral load systems manage forces placed upon the structure by other forces such as high winds, floods, and seismic activity. Vertical load systems may include load-bearing walls and columns. Lateral load systems may include cross-braces, shear walls, and moment-resisting frames. Diaphragms are part of the horizontal structure of the building. The horizontal structure may include the floors of a building and its roof. The diaphragms translate both vertical and lateral loads to the vertical load system and the lateral load system of the building, respectively. The diaphragm is coupled directly to the lateral load system to translate lateral loads. If loads are not properly translated from the diaphragm, the diaphragm may fail, and the structural integrity of the building may be compromised.

SUMMARY

Techniques are generally described that include systems, apparatuses, and methods. An example system may include a diaphragm having two parallel edges, a first pair of horizontal plates coupled to the two parallel edges, a first pair of vertical plates coupled to the two parallel edges, a pair of C-channels, each having a channel surface and a flat surface, a second pair of horizontal plates coupled to the flat surfaces of the C-channels, the second pair of horizontal plates further coupled to the first pair of horizontal plates, a second pair of vertical plates coupled to the flat surfaces of the C-channels, the second pair of vertical plates further coupled to the first pair of vertical plates, a horizontal beam having two opposite ends, a pair of collars configured to slide onto the two opposite ends of the horizontal beam, the pair of collars each including a flange around a perimeter of each of the pair of collars, the flange configured to couple to an end of each of the pair of C-channels, a pair of columns coupled to the two opposite ends of the horizontal beam, and a brace coupled to at least one column of the pair of columns and the horizontal beam.

In some embodiments, the system may include a thermal break material between the first and second pair of horizontal plates.

In some embodiments, the horizontal beam may be an I-beam. In some embodiments, the I-beam includes a pair of smaller C-channels at each end, wherein the pair of smaller C-channels may be configured to fit into channels defined on either side by the I-beam. In some embodiments, the I-beam is enclosed in a fire retardant material. In some embodiments, the I-beam is enclosed in a thermal break material.

In some embodiments, the system may include a thermal break material between the pair of collars and the pair of C-channels.

In some embodiments, the horizontal beam may be coupled to the vertical column by a plate. In some embodiments, the system may include a thermal break material between the vertical column and the plate.

In some embodiments, the diaphragm may include a plurality of panels coupled together.

An example apparatus for coupling at least two beams may include a hollow rectangular prism open at two parallel surfaces configured to be slid around a perimeter of a first beam and attached thereto, and a flange around a perimeter of the hollow rectangular prism, wherein the flange is configured to be coupled to a second beam.

In some embodiments, the hollow rectangular prism may comprise metal.

In some embodiments, the flange may be configured to couple a third beam.

In some embodiments, the flange may be configured to couple the second beam such that the second beam is perpendicular to the first beam.

In some embodiments, the flange may extend a greater distance from the hollow rectangular prism on one side of the hollow rectangular prism than another.

In some embodiments, the flange may include an opening configured to accept a fastener for coupling the flange to the second beam.

An example method may include transmitting a lateral load received at a diaphragm to an edge of the diaphragm, transmitting the lateral load from the edge of the diaphragm to a first horizontal beam via a first interface, transmitting the lateral load from the first horizontal beam to an end of the first horizontal beam to a collar coupled to the first horizontal beam, transmitting the lateral load from the collar to a second horizontal beam, wherein a portion of the second horizontal beam is enclosed by the collar, transmitting the lateral load from the second horizontal beam to a vertical column via a second interface, and transmitting the lateral load from the vertical column to a brace.

In some embodiments, the method may include transmitting the lateral load from the second horizontal beam to the brace.

In some embodiments, the first interface may be a first plurality of plates coupled to the diaphragm, and a second plurality of plates coupled to the first horizontal beam, wherein the first and second plurality of plates may be coupled.

In some embodiments, the second interface may be a plate coupled to the vertical beam and the second horizontal beam.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1A:
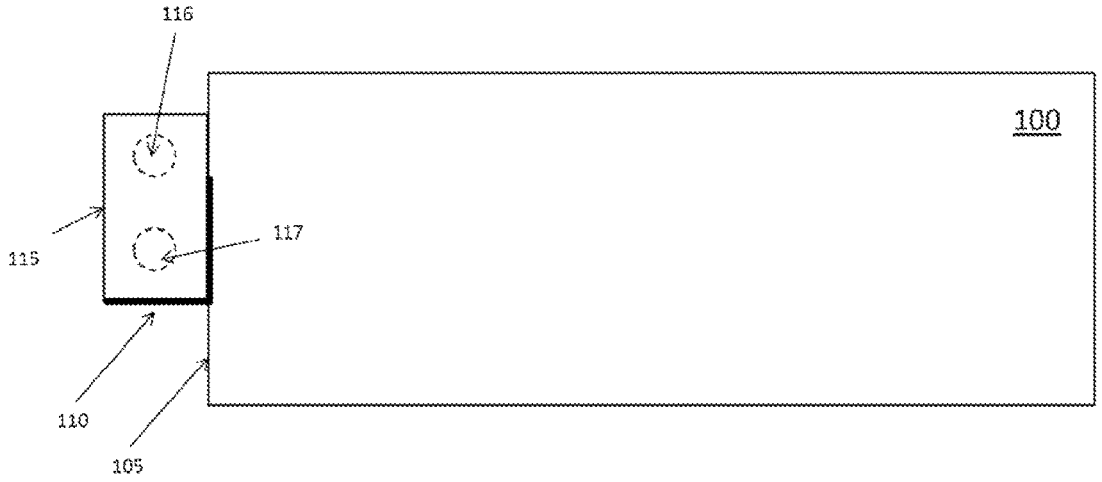
FIG. 1A is a side view of a portion of an example diaphragm.

all arranged in accordance with at least some embodiments of the present disclosure.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

This disclosure is drawn, inter alia, to methods, systems, products, devices, and/or apparatuses generally related to a system that may include a diaphragm having two parallel edges, a first pair of horizontal plates coupled to the two parallel edges, a first pair of vertical plates coupled to the two parallel edges, a pair of C-channels, each having a channel surface and a flat surface, a second pair of horizontal plates coupled to the flat surfaces of the C-channels, the second pair of horizontal plates further coupled to the first pair of horizontal plates, a second pair of vertical plates coupled to the flat surfaces of the C-channels, the second pair of vertical plates further coupled to the first pair of vertical plates, a horizontal beam having two opposite ends, a pair of collars configured to slide onto the two opposite ends of the horizontal beam, the pair of collars each including a flange around a perimeter of each of the pair of collars, the flange configured to couple to an end of each of the pair of C-channels, a pair of columns coupled to the two opposite ends of the horizontal beam, and a brace coupled to at least one column of the pair of columns and the horizontal beam. In this manner, embodiments described herein may transfer lateral forces from a building diaphragm to an exterior structure, such as an exterior steel structure.

In some embodiments, a diaphragm may not need to be coupled directly to a lateral load system in a building. For example, a floor may not be coupled directly to a sheer wall. In some embodiments, the diaphragm may be a floor. The floor may be coupled to a building structure utilizing plates such as clip angles. A set of two vertical and two horizontal clip angles may be coupled to the ends of the floor. A corresponding set of plates may be coupled to the structure. The plates may be coupled together. The floor may receive lateral forces, for example, during an earthquake. The plates may receive lateral loads from the floor panel and transmit them to the structure. The structure may transmit the lateral loads received from the plates to the lateral load system that may be included in the structure.

In some embodiments, a diaphragm may be a floor or a floor panel that has a vertical edge along its perimeter. The diaphragm may be coupled to one or more horizontal C-channels. C-channels are a type of beam used in building structures that are so named due to their "C" shape. The diaphragm may be coupled to the C-channel by coupling vertical and horizontal plates attached to the edge of the diaphragm and the back side of the C-channel. The C-channel may hold the diaphragm at the proper height in the building. The C-channel may be held in place by one or more collars. The end of the C-channel may be coupled to the outside edge of the collar. A horizontal beam may pass through the inside of the collar. The horizontal beam may support the collar. The horizontal beam may be coupled to one or more vertical columns at either end. The vertical columns may support the horizontal beam at the proper height in the building. The vertical columns may be coupled to a cross brace. The cross brace may be a component of the lateral load system of the building. The cross brace may also be coupled to the horizontal beam.

When the diaphragm experiences a lateral load the lateral forces may be translated across the diaphragm and through the vertical and horizontal plates to the C-channel. The C-channel may translate the lateral load to the collars at either end. The collars may translate the load to the horizontal beams, and the horizontal beams may translate the load to the vertical columns. The vertical columns may translate the loads to the cross brace for absorption. The elements of the structure may be configured to translate and absorb the lateral loads while maintaining structural integrity.

In some embodiments, the material composition of the diaphragm to lateral support coupling system may be predominantly steel. In some embodiments it may be predominately aluminum. In still other embodiments, the system components may be made from a variety of building suitable materials ranging from metals and/or metal alloys, to wood and wood polymer composites (WPC), wood based products (lignin), other organic building materials (bamboo) to organic polymers (plastics), to hybrid materials, or earthen materials such as ceramics. In some embodiments cement or other pourable or moldable building materials may also be used. In other embodiments, any combination of suitable building material may be combined by using one building material for some elements of the system and other building materials for other elements of the system. Selection of any material may be made from a reference of material options (such as those provided for in the International Building Code), or selected based on the knowledge of those of ordinary skill in the art when determining load bearing requirements for the structures to be built. Larger and/or taller structures may have greater physical strength requirements than smaller and/or shorter buildings. Adjustments in building materials to accommodate size of structure, load and environmental stresses can determine optimal economical choices of building materials used for all components in the system described herein. Availability of various building materials in different parts of the world may also affect selection of materials for building the system described herein. Adoption of the International Building Code or similar code may also affect choice of materials.

Any reference herein to "metal" includes any construction grade metals or metal alloys as may be suitable for fabrication and/or construction of the system and components described herein. Any reference to "wood" includes wood, wood laminated products, wood pressed products, wood polymer composites (WPCs), bamboo or bamboo related products, lignin products and any plant derived product, whether chemically treated, refined, processed or simply harvested from a plant. Any reference herein to "concrete" includes any construction grade curable composite that includes cement, water, and a granular aggregate. Granular aggregates may include sand, gravel, polymers, ash and/or other minerals.

Turning now to the drawings, FIG. 1A illustrates a side view of a portion of an example diaphragm 100 arranged in accordance with at least some embodiments of the present disclosure. In some embodiments, the diaphragm 100 may be supported by a floor panel, such as a floor ceiling sandwich panel. The diaphragm 100 may be implemented using a concrete pad poured on one or more floor ceiling sandwich panels. The panels may include joists which support the concrete. The diaphragm may have a vertical edge 105 at one end. A horizontal plate 110 may be coupled to the vertical edge 105. In some embodiments, the horizontal plate 110 may be a horizontal clip angle. A vertical plate 115 may also be coupled to the vertical edge 105. In some embodiments, the vertical plate 115 may be a vertical clip angle. The vertical plate 115 may optionally include one or more openings configured to accept fasteners. Two openings 116,117 are illustrated in FIG. 1A. The diaphragm 100 may have a second vertical edge parallel to the vertical edge 105 at the opposite end (not shown in FIG. 1A). The second vertical edge may have a similar arrangement of horizontal and vertical plates coupled to it. The various components described in FIG. 1A are merely embodiments, and other variations, including eliminating components, combining components, and substituting components are all contemplated.

Figure 1B:
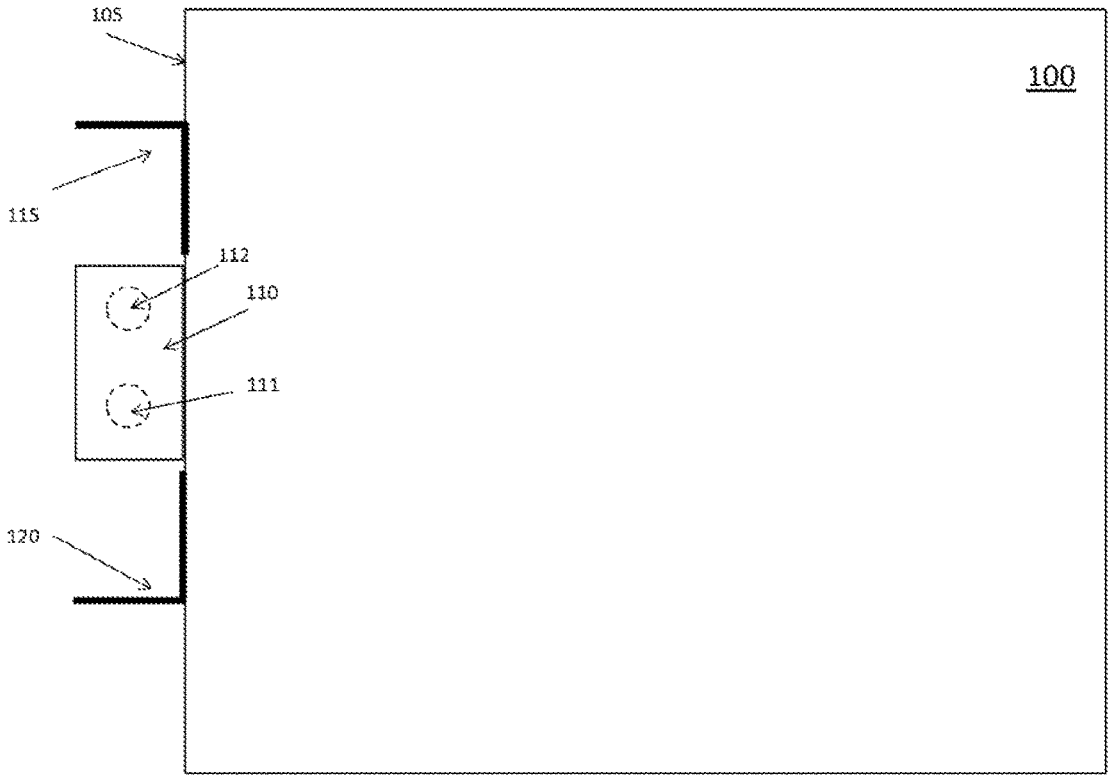
FIG. 1B is a top view of a portion of the example diaphragm.

FIG. 1B is a top view of the portion of the example diaphragm 100 arranged in accordance with at least some embodiments of the present disclosure. In this exemplary embodiment, the vertical edge 105 has two vertical plates 115, 120 and a single horizontal plate 110 coupled to it. The horizontal plate 120 may optionally include one or more openings configured to accept fasteners. Two openings 111, 112 are illustrated in FIG. 1B. In some embodiments, the diaphragm 100 may have one vertical plate and one horizontal plate or two horizontal plates and one vertical plate. In some embodiments, the diaphragm 100 may have multiple groups of horizontal and vertical plates coupled to the vertical edge 105 spaced at regular intervals. In some embodiments, the spacing may be three foot centers. The spacing of the horizontal and vertical plates may be adjusted based on the load requirements of the diaphragm 100. The second vertical edge (not shown in FIG. 1B) parallel to the vertical edge 105 may have a similar arrangement of coupled horizontal and vertical plates. The various components described in FIG. 1B are merely embodiments, and other variations, including eliminating components, combining components, and substituting components are all contemplated.

Figure 2:
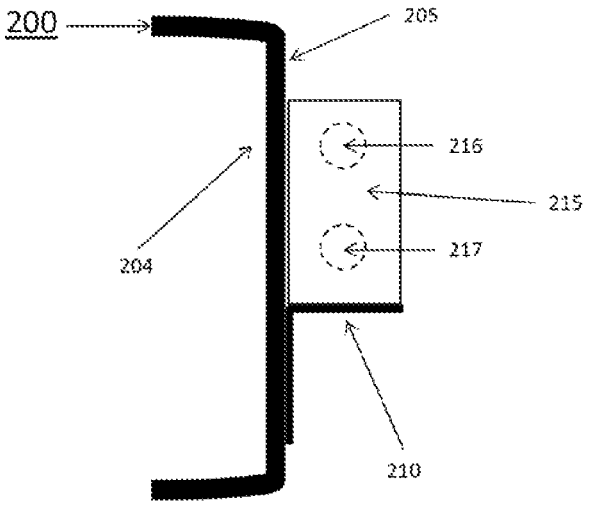
FIG. 2 is a side view of an example C-channel.

FIG. 2 illustrates a side view of an example C-channel 200 arranged in accordance with at least some embodiments of the present disclosure. In some embodiments, the C-channel may be implemented using a metal beam, but other materials may be possible. In some embodiments, the C-channel may be implemented using 36K SI A36 steel. In some embodiments, the C-channel may be made from other formulations of metal. In other embodiments the C-channel may be aluminum, WPC or any other suitable building material. The C-channel 200 may have a channel surface 204 that may define a channel along the length of the C-channel 200. The C-channel 200 may also include a flat surface 205 opposite the channel surface 204. A horizontal plate 210 may be coupled to the flat surface 205. In some embodiments, the horizontal plate 210 may be a horizontal clip angle. A vertical plate 215 may also be coupled to the flat surface 205. In some embodiments, the vertical plate 215 may be a vertical clip angle. The vertical plate 215 may optionally include one or more openings configured to accept fasteners. Two openings 217, 216 are illustrated in FIG. 2. The horizontal plate 210 may also optionally include one or more openings configured to accept fasteners (not shown in FIG. 2). The C-channel 200 may include a plurality of horizontal and vertical plates coupled to the flat surface 205. The arrangement of horizontal and vertical plates coupled to the flat surface 205 may be configured to complement the arrangement of horizontal and vertical plates coupled to the vertical edge 105 of the diaphragm 105. The various components described in FIG. 2 are merely embodiments, and other variations, including eliminating components, combining components, and substituting components are all contemplated.

Figure 3:
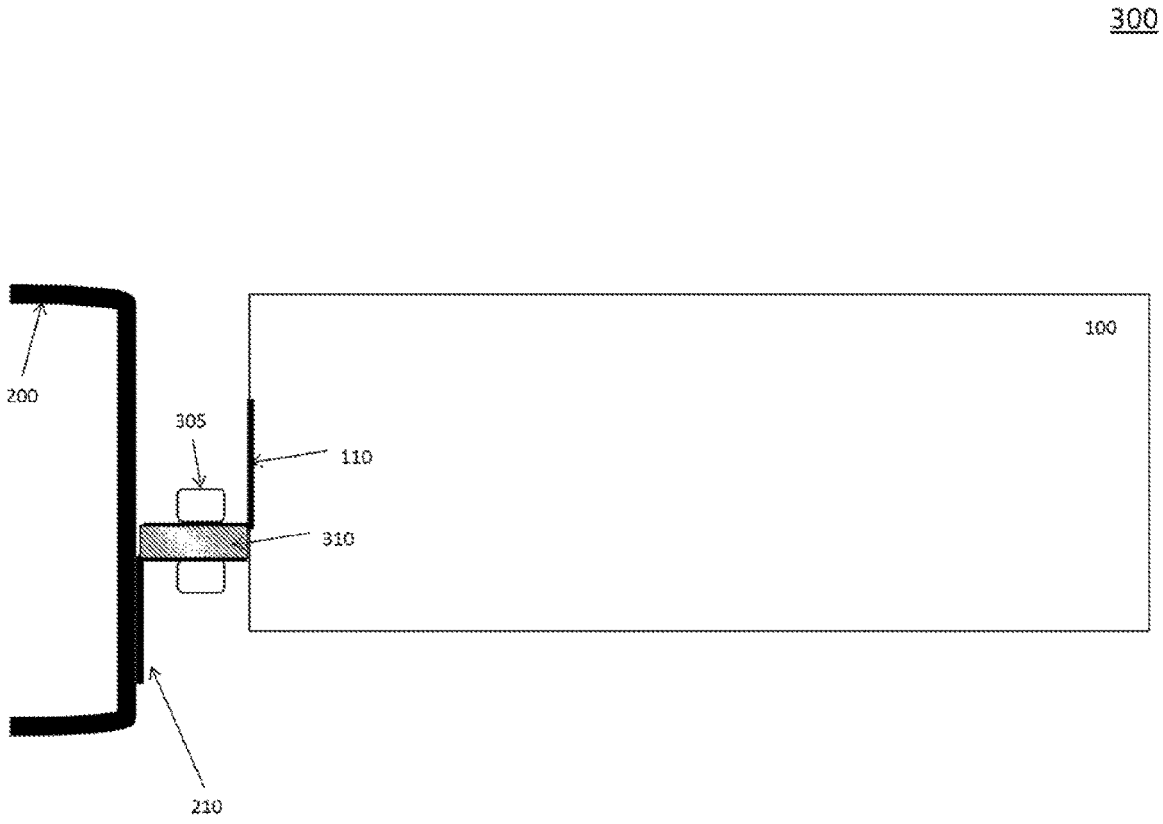
FIG. 3 is a side view of the example C-channel coupled to the example diaphragm.

FIG. 3 illustrates a side view of the example C-channel 200 coupled to the example diaphragm 100 arranged in accordance with at least some embodiments of the present disclosure. For clarity, only the horizontal plates 110, 210 are shown. The diaphragm 100 and C-channel 200 are positioned such that the horizontal plates 110, 210 are aligned. A fastener 305 may pass through an opening in each horizontal plate 110, 210, such as opening 111 (not shown) and secure the horizontal plates 110, 210 together. In some embodiments, the fastener 305 may be a bolt and nut. In some embodiments the bolts may be ASTM A325 and/or A490 bolts. The fastener 305 may also be a rivet. In some embodiments, the two horizontal plates 110, 210 may be welded together—e.g., the fastener may be a weld. In some embodiments, the horizontal plates 110, 210 may be coupled by a combination of methods. The vertical plates of the diaphragm 100 and C-channel 200 not shown may be similarly aligned and coupled together in a similar manner. In some embodiments, the horizontal and vertical plates may be implemented using metal clip angles. In some embodiments, the steel is light-gauge cold-rolled steel. In some embodiments, the steel is hot-rolled structural steel. Any other suitable construction material may be used in some embodiments.

Optionally, a thermal break material 310 may be placed between the vertical and horizontal plates of the diaphragm 100 and the vertical and horizontal plates of the C-channel. The thermal break material 310 may reduce the transfer of heat between the interior and exterior of the structure. In this manner, thermal isolation may be provided between the C-channel 200, which may be connected (and in some embodiments, thermally coupled to) a portion of an exterior of a structure, and the diaphragm 100, which may form a portion of an interior of a structure. In some embodiments, the thermal break material 310 may be a mineral and polymer composite. In some embodiments, the thermal break material is a fabric-reinforced resin. An example of a fabric-reinforced resin is Armatherm™ FRR, which is produced by Armadillo Noise & Vibration. Other fabric-reinforced resin materials may also be used. A second C-channel (not shown) may be coupled to the opposite vertical edge of the diaphragm (not shown) in an analogous manner as described above. The various components described in FIG. 3 are merely embodiments, and other variations, including eliminating components, combining components, and substituting components are all contemplated.

Figure 4:
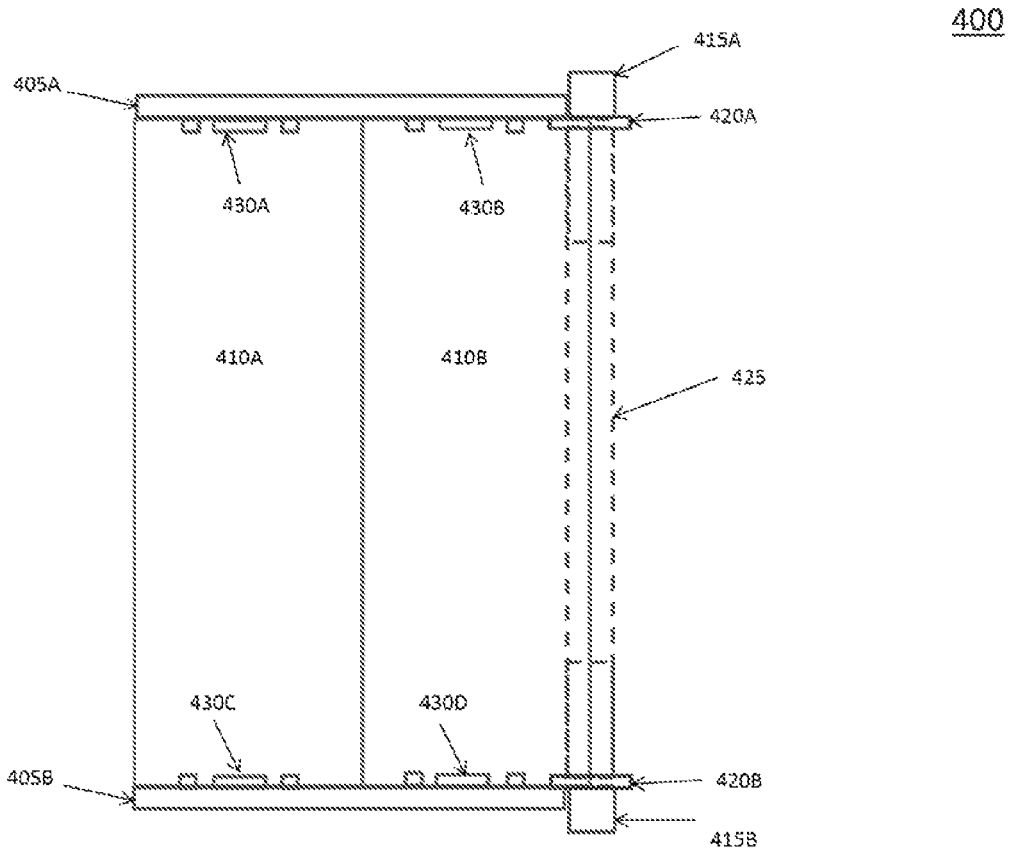
FIG. 4 is a top view of a portion of an example floor.

FIG. 4 illustrates a top view of a portion of an example floor 400 arranged in accordance with at least some embodiments of the present disclosure. The floor 400 may be one of a plurality of floors in a building. The plurality of floors in the building may have a similar structure to the example floor 400. The floor 400 may include C-channels 405A, B. The C-channels 405A, B may each be implemented, for example, using the C-channel 200 shown and described with reference to FIG. 2. The C-channels 405A,B may be coupled to one or more panels supporting a building diaphragm in some embodiments. Two panels 410A, B are shown in FIG. 4, but less or more panels may be used in various embodiments. Multiple panels such as panels 410A, B may be coupled together and a concrete floor poured such that the panels and concrete act as a single integral diaphragm of the structure (e.g., a floor of the structure). For example, the panels 410A, B may be implemented using floor-ceiling sandwich panels including joists and an upper surface over the joists, which may, for example, provide acoustical damping and radiant heating. In some embodiments, the joists and upper surface may be implemented with light gauge steel. In some embodiments, the joists may be implemented with wood, and the upper surface may be implemented with plywood. Multiple panels may be coupled between the two C-channels 405A, B by a plurality of vertical and horizontal plates 430A-D in a similar manner as described in reference to FIG. 3. A layer of concrete may be poured over an upper surface of the multiple panels. In some embodiments, lightweight concrete may be used. Once the concrete has cured, the multiple panels 410A, B including the concrete may then behave as a single diaphragm 410 for transferring vertical and lateral loads to the structure. Other methods of integrating individual panels into a single diaphragm may also be used.

Still referring to FIG. 4, the C-channels 405A,B may be coupled to collars 420A,B on at least one end. The collars 420A,B may encase a portion of a horizontal beam 425. The beam 425 may be attached at either end to vertical columns 415A,B. The vertical columns 415A,B may be components of a vertical load system of the building. The various components described in FIG. 4 are merely embodiments, and other variations, including eliminating components, combining components, and substituting components are all contemplated.

Figure 5:
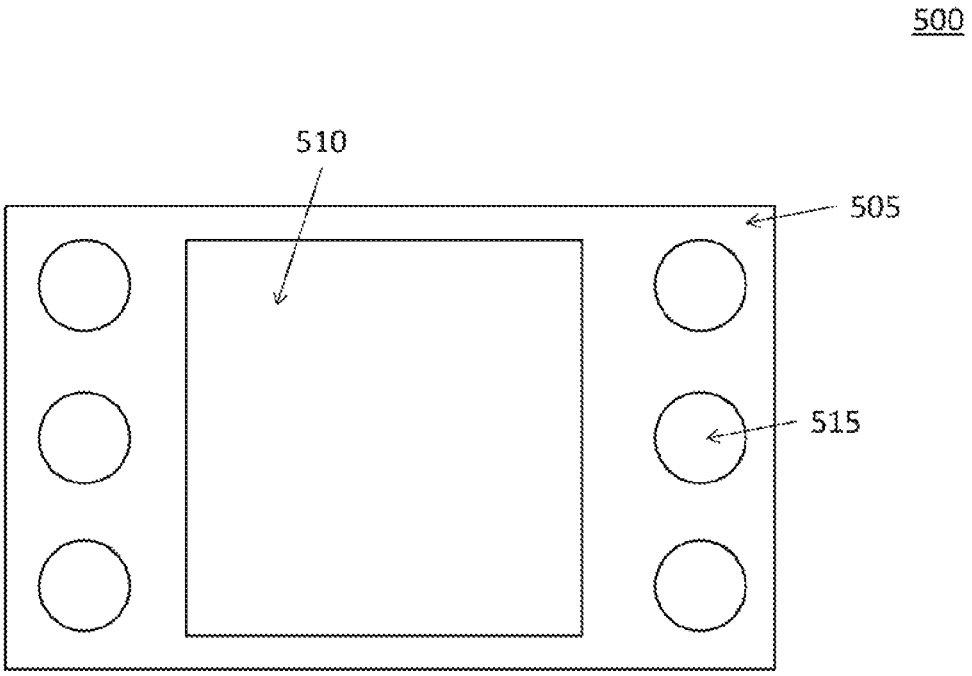
FIG. 5 is a front view of an example collar.

FIG. 5 illustrates a front view of an example collar 500 arranged in accordance with at least some embodiments of the present disclosure. The example collar 500 may be used to implement the collars 420A,B in FIG. 4. The collar 500 may be a hollow rectangular prism open at either end. The opening 510 in the collar 500 may be large enough to slide around a perimeter of a beam, such as beam 425 in FIG. 4. The collar 500 may also include a flange 505 around its perimeter. The flange may be perpendicular to a beam encased in the collar. In some embodiments, the flange 505 is wider on one or more sides of the collar 500. The flange 505 may be configured to couple to a second beam. The second beam may be the C-channel 405 in FIG. 4. In some embodiments the collar 500 may be configured to couple to beams to the flange 505 on two or more sides of the collar 500. The flange 505 may include one or more openings, such as opening 515, that are configured to receive a fastener. In some embodiments, the collar 500 may be implemented using 36K SI A36 steel. In some embodiments, the collar may be implemented with wood or a composite of multiple materials such as plywood. Any other suitable construction material may be used in some embodiments. The various components described in FIG. 5 are merely embodiments, and other variations, including eliminating components, combining components, and substituting components are all contemplated.

Figure 6:
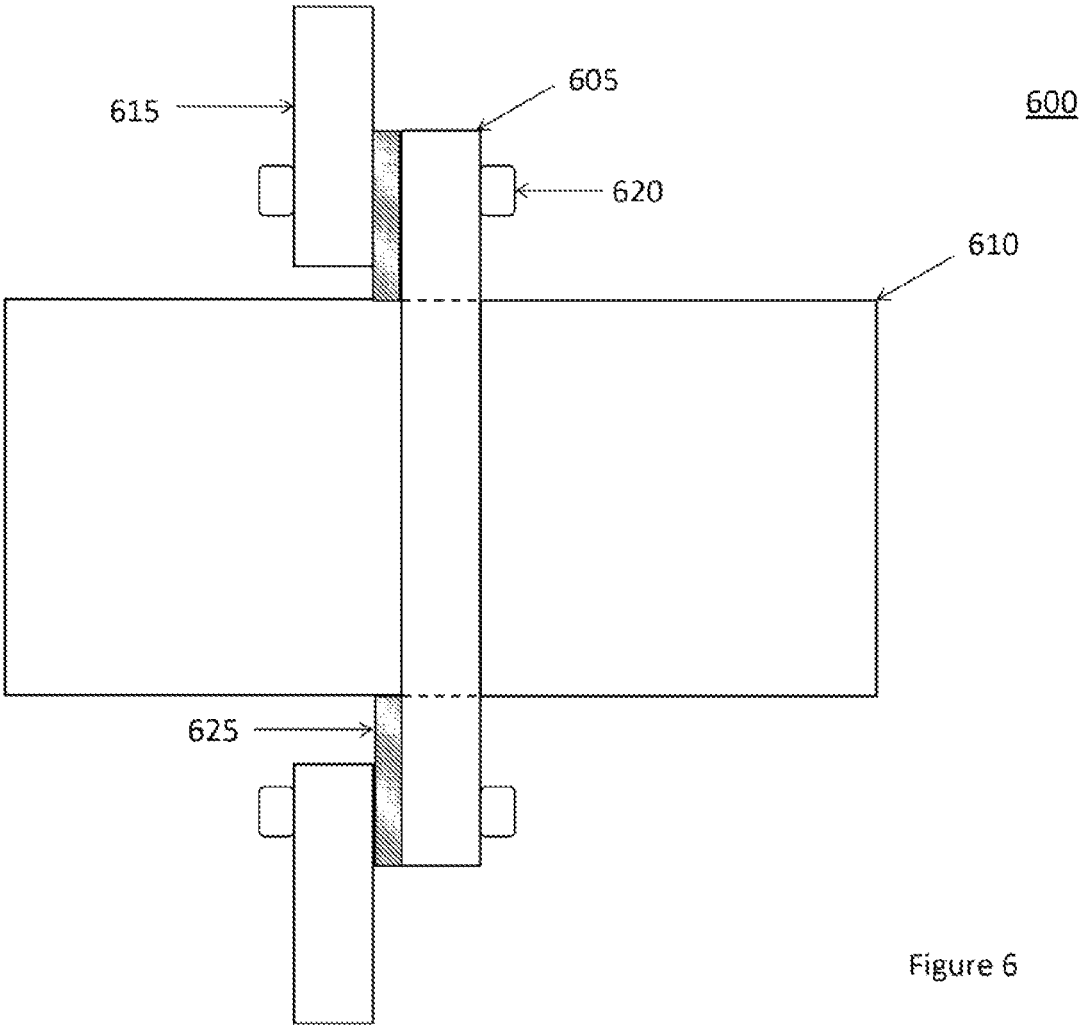
FIG. 6 is a top view of an example collar around an example beam and coupled to a second example beam.

FIG. 6 illustrates a top view 600 of an example collar 605 around an example beam 610 and coupled to a second example beam 615 arranged in accordance with at least some embodiments of the present disclosure. The collar 605 may be implemented using the collar 500 in FIG. 5. In some embodiments, the second beam 615 may be a C-channel similar to C-channel 200 in FIG. 2. The second beam 615 may be coupled to the collar by a fastener 620. The fastener 620 may be a bolt and nut or a rivet. Other fasteners may also be used. In some embodiments, the second beam 615 may be welded to the collar 605. Optionally, a thermal break material 605 may be placed between the second beam 615 and the collar 605. This may reduce heat exchange between the interior and exterior of the building. For example, the collar 605 may be in thermal communication with the exterior of the building (e.g., the vertical supporting beams 415A and 415B of FIG. 4). The second beam 615 may be in thermal communication with the diaphragm, as described with reference to C-channels 405A and 405B of FIG. 4, which may form a portion of an interior of the building. The thermal break material 605 may then isolate the interior and exterior portions of the building from one another. The various components described in FIG. 6 are merely embodiments, and other variations, including eliminating components, combining components, and substituting components are all contemplated.

Figure 7:
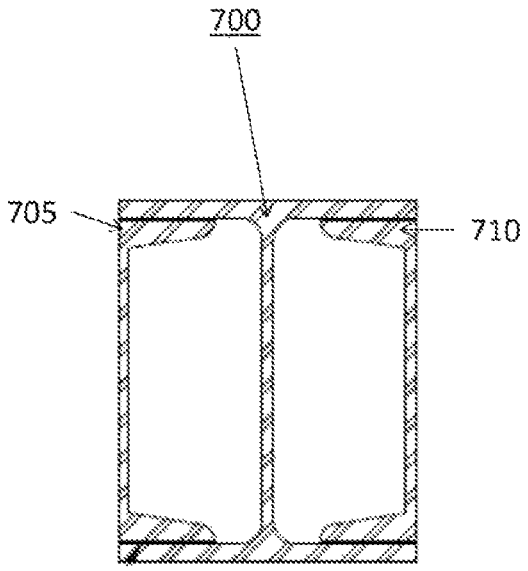
FIG. 7 is a front view of an example horizontal beam.

FIG. 7 illustrates a front view of an example horizontal beam 700 arranged in accordance with at least some embodiments of the present disclosure. The horizontal beam 700 may be used as horizontal beam 425 in FIG. 4. In some embodiments, horizontal beam 700 is an I-beam. The I-beam may be re-enforced by one or more smaller C-channels 705,710 at either end. The smaller C-channels 705, 710 may be sized to fit within the channels formed on either side of the I-beam. The smaller C-channels 705, 710 may be welded to the horizontal beam 700 or coupled by another method or combination of methods. The smaller C-channels 705, 710 may run the entire length of the horizontal beam 700 or may only extend a portion of the length of the horizontal beam 700. In some embodiments, there may be four smaller C-channels coupled to the horizontal beam 700, with two smaller C-channels reinforcing each end portion of the horizontal beam 700. The reinforcement may improve the horizontal beam's 700 ability to resist torsion. Optionally, the horizontal beam 700 may be wrapped in layers of thermal break material. This may reduce heat exchange between the interior (e.g., the panels and diaphragm described herein) and the exterior (e.g., exterior metal frame) of the structure. It may also be wrapped in fire retardant material. This may improve the fire rating of the structure. In some embodiments, the entire horizontal beam 700 may be wrapped in thermal break and/or fire retardant material. In other embodiments, only the end portions of the horizontal beam 700 are wrapped. When the horizontal beam 700 is wrapped in one or more materials, the collar 500 may have an opening sized to accommodate the materials and the horizontal beam 700. In some embodiments, the horizontal beam 700 and the smaller C-channels 705, 710 may be implemented using 36K SI A36 steel. Any other suitable construction material may be used in some embodiments. The various components described in FIG. 7 are merely embodiments, and other variations, including eliminating components, combining components, and substituting components are all contemplated.

Figure 8:
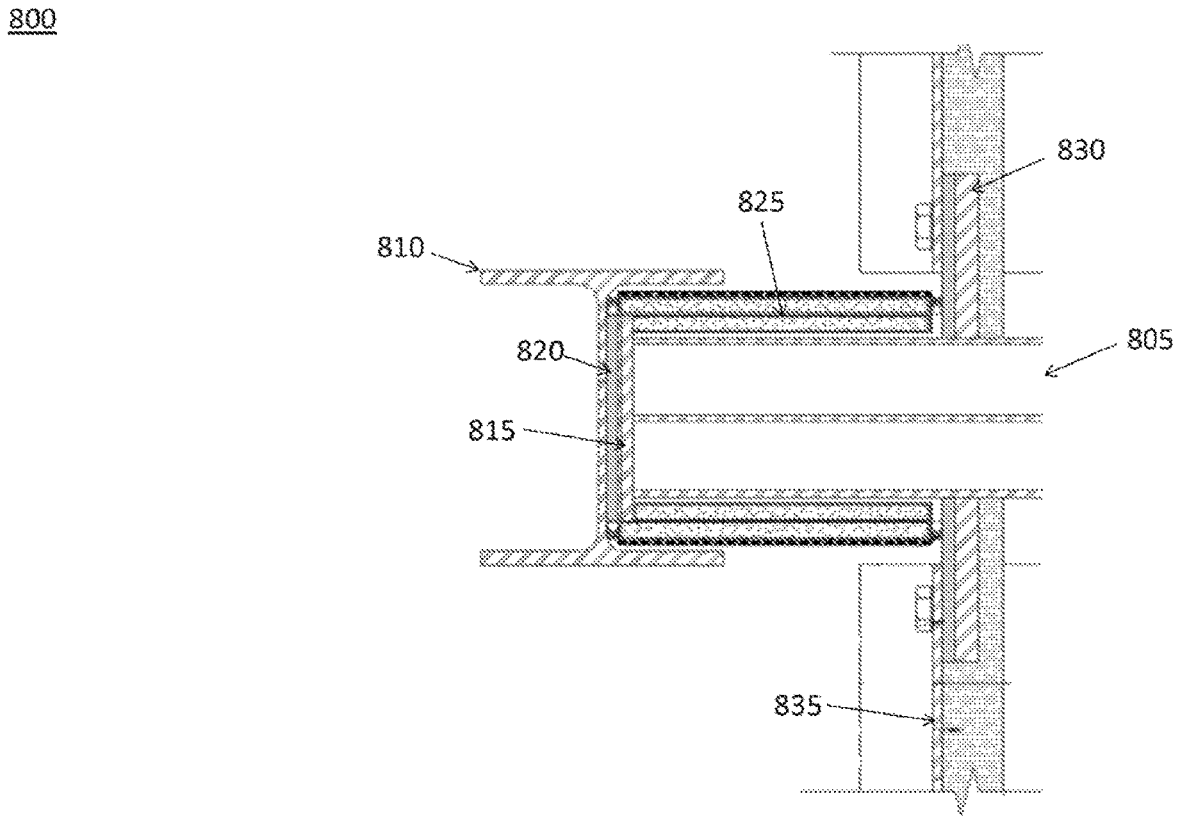
FIG. 8 is a top view of an example horizontal beam coupled to an example vertical column.

FIG. 8 illustrates a top view 800 of an example horizontal beam 805 coupled to an example vertical column 810 arranged in accordance with at least some embodiments of the present disclosure. The horizontal beam 805 may be implemented using the horizontal beam 700 shown in FIG. 7. The horizontal beam 805 is shown with the optional fire retardant and thermal break material wraps 825. The horizontal beam 805 also has a collar 830 coupled to C-channels 835. The vertical column 810 is coupled to the horizontal beam 805. In some embodiments, the vertical column 810 is coupled to the horizontal beam 805 by a metal plate 815. Optionally, a thermal break material 820 may be included between the vertical column 810 and the metal plate 815. In some embodiments, the vertical column 810 is an I-beam. The I-beam of the vertical column may be configured such that the end of the horizontal beam 805 fits within the channel defined by the I-beam. In some embodiments, the vertical column 810 may be implemented using 36K SI A36 steel. Any other suitable construction material may be used in some embodiments. The various components described in FIG. 8 are merely embodiments, and other variations, including eliminating components, combining components, and substituting components are all contemplated.

Figure 9:
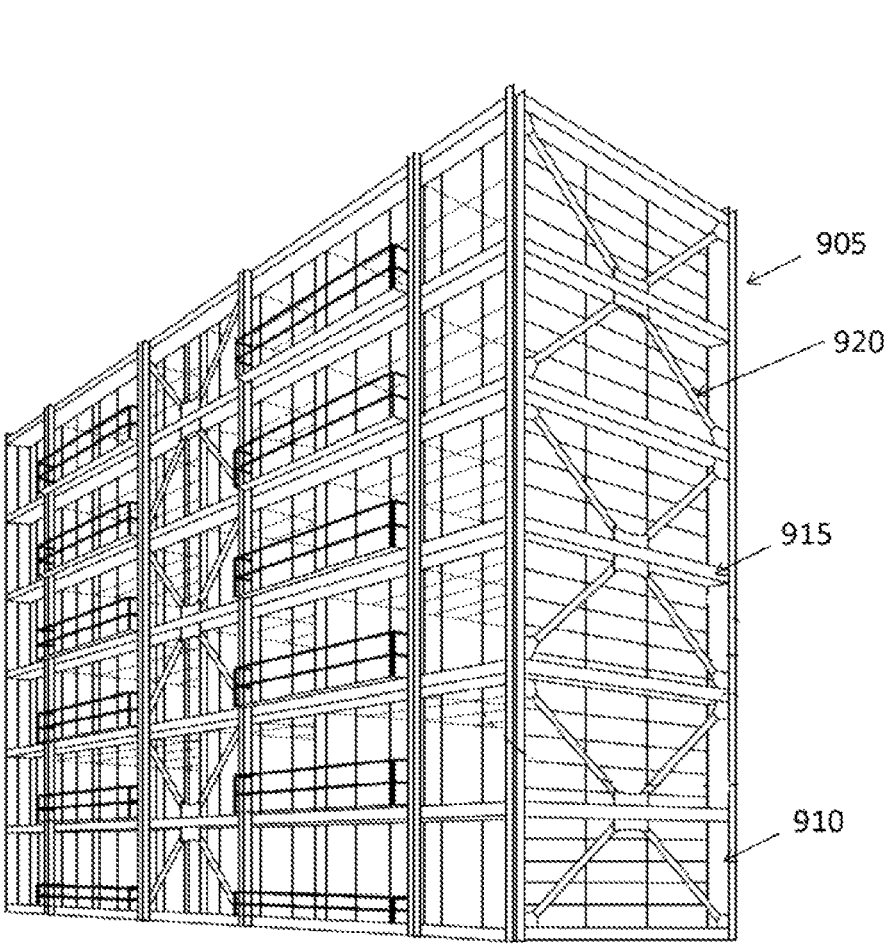
FIG. 9 is a schematic illustration of an example multi-story building.

FIG. 9 provides a schematic illustration of an example multi-story building 900 arranged in accordance with at least some embodiments of the present disclosure. The building 900 may include two or more stories or levels. The building 900 may include a corresponding number of stories to be classified as a low-rise, mid-rise, or high-rise construction. In FIG. 9, the building 900 includes six stories. In some embodiments, the building 900 may be a residential multi-dwelling building having eight or more stories.

The building 900 may include a structural, external frame 905. The external frame 905 may serve as a structural exoskeleton of the building 900. The external frame 905 may include multiple columns 910, beams 915, and cross braces 920. The columns 910 may be oriented vertically, the beams 915 may be oriented horizontally, and the cross braces 920 may be oriented obliquely to the columns 910 and the beams 915. One or more columns 910 may correspond to column 810 as shown in FIG. 8 and may be included in the vertical load system of the building. One or more beams 915 may correspond to horizontal beam 700 as shown in FIG. 7. The beams 915 may extend between and be attached to adjacent columns 910 to connect the adjacent columns 910 to one another. The cross braces 920 may extend between and be attached to contiguous beams 915 and columns 910 to provide additional stiffness to the external frame 905. The cross braces 920 may be included in the lateral support system of the building 900. In some embodiments, the cross braces are an X-brace design such that the cross braces appear to form one or more letter "X." In some embodiments, the cross braces may be implemented using 36K SI A36 steel. Alternatively other suitable construction material may be used. The external frame 905 may provide the structural support for the building 900. The various components described in FIG. 9 are merely embodiments, and other variations, including eliminating components, combining components, and substituting components are all contemplated.

Reference will now be made to both FIGS. 4 and 9 to describe the translation of lateral loads from the diaphragms of the building 900 to the external frame 905. Translation of large lateral loads may occur for example, during an earthquake. A lateral load applied to a diaphragm, such as diaphragm 410, in FIG. 4, may be transmitted via the vertical and horizontal plates 430A-B to the C-channels 405A,B. The C-channels 405A,B in turn transmit the load to the horizontal beam 425 via the collars 420A,B. The horizontal beam 425 may be implemented using beam 915 in FIG. 9. The beam 915 then transmits the lateral load to the attached vertical beams 910 and braces 920 for absorption. The translation of lateral loads from the diaphragm to the lateral load system may prevent failure of the diaphragm. This may preserve the structural integrity of the building 900.

Figure 10:
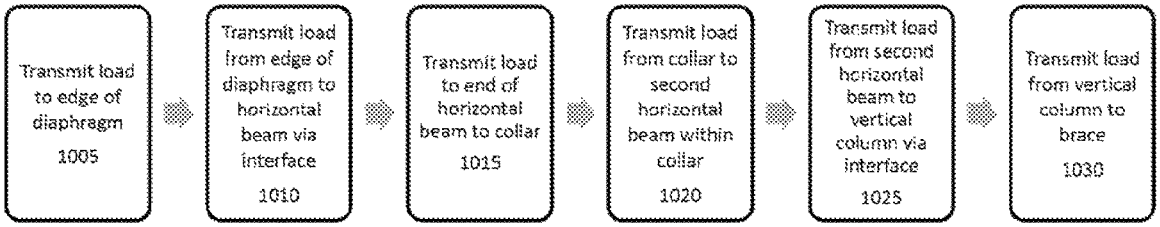
FIG. 10 is a flowchart of an example method.

FIG. 10 illustrates a flowchart of an example method 1000 arranged in accordance with at least some embodiments of the present disclosure. The example method 1000 may be a process of translating loads from a diaphragm to a lateral load system. An example method may include one or more operations, functions or actions as illustrated by one or more of blocks 1005, 1010, 1015, 1020, 1025, and/or 1030. The operations described in the blocks 1005 through 1030 may be performed in response to applying a load.

An example process may begin with block 1005, which recites "transmit load to edge of diaphragm." Block 1005 may be followed by block 1010, which recites "transmit load from edge of diaphragm to horizontal beam via interface." An interface may be a horizontal and/or a vertical plate coupling the diaphragm and the horizontal beam. Block 1010 may be followed by block 1015, which recites, "transmit load to end of horizontal beam to collar." Block 1015 may be followed by block 1020 which recites, "transmit load from collar to second horizontal beam within collar." Block 1020 may be followed by block 1025, which recites, "transmit load from second horizontal beam to vertical column via interface." Block 1025 may be followed by block 1030, which recites, "transmit load from vertical column to brace."

The blocks included in the described example methods are for illustration purposes. In some embodiments, the blocks may be performed in a different order. In some other embodiments, various blocks may be eliminated. In still other embodiments, various blocks may be divided into additional blocks, supplemented with other blocks, or combined together into fewer blocks. Other variations of these specific blocks are contemplated, including changes in the order of the blocks, changes in the content of the blocks being split or combined into other blocks, etc. In some embodiments, a plurality of diaphragms may operate independently to transmit lateral loads from locations on the diaphragms to the horizontal beam. In some embodiments, the brace may be coupled to both the vertical column and the second horizontal beam. The second horizontal beam may transmit lateral loads to the vertical column and the brace simultaneously.

Block 1005 recites, "transmit load to edge of diaphragm." When the diaphragm experiences a lateral load, the diaphragm transmits the load away from the center of the diaphragm to the periphery of the diaphragm. The diaphragm may be a floor or a roof in a building. In some embodiments, the floor may comprise a frame of wooden joists. The floor may also comprise a floor-ceiling panel. The floor-ceiling panel may include a frame having a plurality of joists and opposing end members. The joists may form horizontal supporting members that span the distance between the opposing end members to support the floor of an upper unit and the ceiling of a lower unit. The joists may transmit loads along the diaphragm. The joists may be oriented perpendicular to the end members. The end members may provide parallel vertical edges of the diaphragm. In some embodiments, the frame is formed of a metal, such as aluminum or steel, for fire resistance, structural strength, weight reduction, or other factors.

Block 1010 recites, "transmit load from edge of diaphragm to horizontal beam via interface." The lateral load transmitted to the edge of the diaphragm crosses an interface to be received by a horizontal beam. In some embodiments, the interface may be a combination of vertical and horizontal plates coupled to the diaphragm and the horizontal beam that are then coupled to each other. In some embodiments, interface may be a weld between the diaphragm and the horizontal beam. In some embodiments, the horizontal beam may be a C-channel.

Block 1015 recites, "transmit load to end of horizontal beam to collar." The lateral load is transmitted from where the interface is coupled to the horizontal beam to the end of the horizontal beam where it is coupled to a collar. In some embodiments, the horizontal beam is coupled to collars at both ends. The collar may be bolted, riveted, and/or welded to the horizontal beam. Other coupling methods may be possible. The collar may be a metal, such as aluminum or steel.

Block 1020 recites, "transmit load from collar to second horizontal beam within collar." In some embodiments, collar may have an opening configured to slide onto a second horizontal beam. A portion of the second horizontal beam may be encased within the collar. In some embodiments, the second horizontal beam may be perpendicular to the first horizontal beam coupled to the collar.

Block 1025 recites, "transmit load from second horizontal beam to vertical column via interface." The lateral load may be transmitted along the second horizontal beam to its end where it is coupled to a vertical column. In some embodiments, the second horizontal beam is coupled to vertical columns at both ends. The interface coupling the second horizontal beam and the vertical column may be a metal plate. Block and/or bolts may also be used to interface the vertical column to the second horizontal beam in some embodiments.

Block 1030 recites, "transmit load from vertical column to brace." The lateral load may be transmitted from the vertical column to a brace where the lateral load is absorbed. The brace may be bolted, welded, and/or riveted to the vertical column. Other coupling mechanisms may also be used. In some embodiments, the brace may be an X-brace. In some embodiments, multiple braces are coupled to the vertical column.

Figure 11:
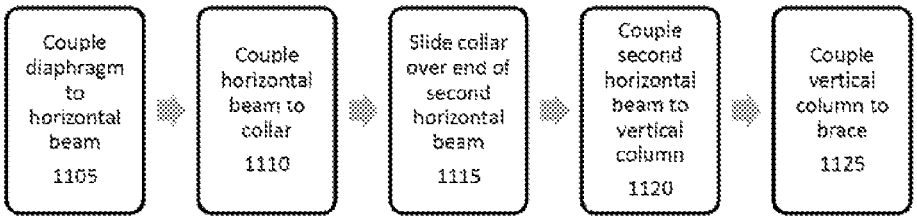
FIG. 11 is a flow chart of an example method.

FIG. 11 is a flowchart of an example method 1100 arranged in accordance with at least some embodiments of the present disclosure. The example method 1100 may be a process of assembling a system. An example method may include one or more operations, functions or actions as illustrated by one or more of blocks 1105, 1110, 1115, 1120, and/or 1125.

An example process may begin with block 1105, which recites "couple diaphragm to horizontal beam." Block 1105 may be followed by block 1110, which recites "couple horizontal beam to collar." Block 1110 may be followed by block 1115, which recites, "slide collar over end of second horizontal beam." Block 1115 may be followed by block 1120 which recites, "couple second horizontal beam to vertical column." Block 1120 may be followed by block 1125, which recites, "couple vertical column to brace."

The blocks included in the described example methods are for illustration purposes. In some embodiments, the blocks may be performed in a different order. In some other embodiments, various blocks may be eliminated. In still other embodiments, various blocks may be divided into additional blocks, supplemented with other blocks, or combined together into fewer blocks. Other variations of these specific blocks are contemplated, including changes in the order of the blocks, changes in the content of the blocks being split or combined into other blocks, etc. In some embodiments, a plurality of diaphragms may be coupled to the horizontal beam. In some embodiments, the brace may be coupled to both the vertical column and the second horizontal beam. In some embodiments, the brace may be coupled to the vertical column and a second vertical column. In some embodiments, the vertical column may be coupled to the brace and second horizontal beam before the diaphragm is coupled to the horizontal beam.

Block 1105 recites, "couple diaphragm to horizontal beam." In some embodiments, the diaphragm may have an edge that may be coupled to a horizontal beam. In some embodiments, a combination of vertical and horizontal plates coupled to the diaphragm and the horizontal beam may be coupled to each other. In some embodiments, the diaphragm may be welded to the horizontal beam. In some embodiments, the horizontal beam may be a C-channel.

Block 1110 recites, "couple horizontal beam to collar." The end of the horizontal beam is coupled to a collar. In some embodiments, the horizontal beam is coupled to a flange extending from the perimeter of the collar. In some embodiments, the horizontal beam is coupled to collars at both ends. The collar may be bolted, riveted, and/or welded to the horizontal beam. Other coupling methods may be possible. The collar may be a metal such as aluminum or steel. In some embodiments, the collar may be coupled to more than one horizontal beam on the perimeter of the collar.

Block 1115 recites, "slide collar over end of second horizontal beam." In some embodiments, the collar may have an opening configured to slide onto a second horizontal beam and then secured to the second horizontal beam. In some embodiments, the opening is a rectangular prism. In some embodiments, the second horizontal beam may be coupled such that it is perpendicular to the first horizontal beam coupled to the collar.

Block 1120 recites, "couple second horizontal beam to vertical column." In some embodiments, the second horizontal beam is coupled to vertical columns at both ends. The second horizontal beam and the vertical column may be coupled by a metal plate. Blocks and/or bolts may also be used to interface the vertical column to the second horizontal beam in some embodiments.

Block 1125 recites, "couple vertical column to brace." The lateral load may be transmitted along the second horizontal beam to its end where it is coupled to a vertical column. The brace may be bolted, welded, and/or riveted to the vertical column. Other coupling mechanisms may also be used. In some embodiments, multiple braces are coupled to the vertical column.

Example I

In a first non-limiting example, all components are made of 36 K SI A36 construction steel, or like caliber material.

The structure may include two pairs of vertical columns. The vertical columns may be I-beams. Each pair of vertical columns may be coupled by a horizontal beam reinforced at each end with smaller C-channels. The two horizontal beams may be enclosed by a collar at each end near the vertical columns. Two C-channels may be coupled at either end to the four collars coupled to the horizontal beams. The C-channels may span the two pairs of vertical columns such that they span a direction substantially perpendicular to the horizontal beams. The C-channels may also be implemented using 36K SI A36 steel. A cross brace may be coupled to two of the vertical columns and one of the horizontal beams. The cross brace may be implemented using 36K SI A36 steel.

A diaphragm for the structure may include a plurality of punched studs made from a light gauge steel or other metal. A frame implemented with light gauge steel beams may form a perimeter around the plurality of studs. The diaphragm may be eight feet wide and twenty-two feet long. A corrugated metal decking may be bolted to the metal frame over the studs, forming an upper surface. Vertical and horizontal metal clip angles may be welded to the two eight-foot edges of the frame. Two vertical and two horizontal clip angles may be welded every three feet along the two edges of the frame.

Corresponding metal clip angles may be welded to the pair of C-channels. A crane may lift the diaphragm to the elevation of the C-channels. The corresponding clip angles may then be bolted together to secure the diaphragm to the C-channel. A three inch layer of light weight concrete may then be poured and cured over the diaphragm.

Example II

In a second non-limiting example, a structure may include two pairs of vertical columns. The vertical columns may be wooden joists, which may be implemented using lam beam. Each pair of vertical columns may be coupled by a horizontal beam which may be implemented using a wooden beam. The vertical columns may extend up to four stories high. The two horizontal beams may be enclosed by a collar at each end proximate the vertical columns. The collars may be implemented using a panel of plywood with a cutout. Two C-channels may be coupled at either end to the four collars coupled to the horizontal beams. The C-channels may span the two pairs of vertical columns such that they span a direction substantially perpendicular to the horizontal beams. The C-channels may be made from wood or wood based products like WPC. A cross brace may be coupled to two of the vertical columns and one of the horizontal beams. The cross brace may be implemented using a wooden beam.

A diaphragm for the structure may include a plurality of wooden joists. The joists may be placed at sixteen inch centers. A frame implemented with wooden beams may form a perimeter around the joists. The diaphragm may be eight feet wide and twelve feet long. A plywood decking may be screwed to the wooden frame over the joists, forming an upper surface. Vertical and horizontal metal clip angles may be screwed to the two eight-foot edges of the frame. Two vertical and two horizontal clip angles may be screwed every three feet along the two edges of the frame.

Corresponding metal clip angles may be screwed to the pair of C-channels. A mechanical lift system may be used to raise the diaphragm to the elevation of the C-channels. The corresponding clip angles may then be bolted together to secure the diaphragm to the C-channel. Carpeting and/or laminate flooring may then be installed over the plywood diaphragm.

Example III

In a third non-limiting example, a structure may include two pairs of vertical columns. The vertical columns may be I-beams, which may be implemented using metal. The vertical columns may extend up to ten stories. Each pair of vertical columns may be coupled by a horizontal beam which may be implemented using a metal I-beam. The horizontal beam may be reinforced at each end with aluminum blocks wedged into the channels formed by the I-beam. The two horizontal beams may be enclosed by a collar at each end proximate the vertical columns. The collars may be implemented using metal. Two C-channels may be coupled at either end to the four collars coupled to the horizontal beams. The C-channels may span the two pairs of vertical columns such that they span a direction substantially perpendicular to the horizontal beams. The C-channels may be implemented using metal. A cross brace may be coupled to two of the vertical columns and one of the horizontal beams. The cross brace may be implemented using a metal beam. The metal used to implement the elements described above may be a lower grade metal. The metal may be reclaimed and/or recycled scrap metal.

A diaphragm for the structure may include a plurality of metal joists. The joists may be placed at two foot centers. A frame implemented with metal beams may form a perimeter around the joists. The diaphragm may be eight feet wide and twelve feet long. A wire mesh decking may be screwed to the metal frame over the joists, forming an upper surface. Vertical and horizontal aluminum clip angles may be screwed to the two eight-foot edges of the frame. Two vertical and two horizontal clip angles may be screwed every three feet along the two edges of the frame. The metal used to implement the elements described above may be a lower grade metal. The metal may be reclaimed and/or recycled scrap metal.

Corresponding aluminum clip angles may be screwed to the pair of C-channels. A crane or a mechanical lift system may be used to raise the diaphragm to the elevation of the C-channels. The corresponding clip angles may then be bolted together to secure the diaphragm to the C-channel. A layer of cement may then be poured over the decking.

The examples provided are for explanatory purposes only and should not be considered to limit the scope of the disclosure. Each example embodiment may be practical for a particular environment such as urban mixed-use developments, low-rise residential units, and/or remote communities. Materials and dimensions for individual elements may be configured to comply with one or more of the following building codes: fire, energy, handicap, life-safety, and acoustical (impact and ambient noise transfer) without departing from the scope of the principles of the disclosure. The elements and/or system may also be configured to comply with social and/or religious codes as desired. For example, materials, systems, methods, and/or apparatuses may be configured to comply with the International Building Code as it has been adopted in a jurisdiction.

The present disclosure is not to be limited in terms of the particular embodiments described in this application, which are intended as illustrations of various aspects. Many modifications and embodiments can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and embodiments are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 items refers to groups having 1, 2, or 3 items. Similarly, a group having 1-5 items refers to groups having 1, 2, 3, 4, or 5 items, and so forth.

The herein described subject matter sometimes illustrates different components contained within, or connected with, different other components. It is to be understood that such depicted architectures are merely embodiments, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific embodiments of operably couplable include but are not limited to physically mateable and/or physically interacting components and/or wirelessly interactable and/or wirelessly interacting components and/or logically interacting and/or logically interactable components.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An apparatus to couple first and second horizontal beams of a building system, the apparatus comprising:

a hollow rectangular collar with a first opening that runs horizontally through the hollow rectangular collar such that the hollow rectangular collar is open at two parallel surfaces of the hollow rectangular collar, wherein the first opening receives the first horizontal beam and is sized to enclose at least a portion of a perimeter of the first horizontal beam, and wherein an end of the first horizontal beam passes horizontally through the first opening and is attached to a first vertical column of the building system, wherein the building system further includes:

a diaphragm having an edge;

a first interface to couple the edge of the diaphragm to the second horizontal beam;

a second interface to couple the first vertical column to the end of the first horizontal beam; and a brace coupled to the first vertical column and to the first horizontal beam, and operable to absorb at least a portion of a load from at least one of the first vertical column and the first horizontal beam; and a flange around at least a portion of a perimeter of the hollow rectangular collar, wherein the flange is operable to be coupled to the second horizontal beam, and wherein the flange is positioned perpendicular to the first horizontal beam.

2. The apparatus of claim 1, wherein the hollow rectangular collar comprises metal.

3. The apparatus of claim 1, wherein the flange is further operable to be coupled to a third horizontal beam.

4. The apparatus of claim 1, wherein the flange is operable to be coupled to the second horizontal beam such that the second horizontal beam is perpendicular to the first horizontal beam after the flange is coupled to the second horizontal beam.

5. The apparatus of claim 1, wherein the flange extends a greater distance from the hollow rectangular collar on one side of the hollow rectangular collar than on another side of the hollow rectangular collar.

6. The apparatus of claim 1, wherein the flange includes a second opening that is sized to accept a fastener to couple the flange to the second horizontal beam.

7. A building system, comprising:

a first vertical column;

a collar with a first opening that runs horizontally through the collar to receive a first horizontal beam, wherein the first opening is sized to enclose at least a portion of a perimeter of the first horizontal beam, and wherein an end of the first horizontal beam passes horizontally through the first opening and is attached to the first vertical column;

a flange around at least a portion of a perimeter of the collar, wherein the flange is operable to be coupled to a second horizontal beam, and wherein the flange is positioned perpendicular to the first horizontal beam;

a diaphragm having an edge;

a first interface to couple the edge of the diaphragm to the second horizontal beam;

a second interface to couple the first vertical column to the end of the first horizontal beam; and a brace coupled to the first vertical column and to the first horizontal beam, and operable to absorb at least a portion of a load from at least one of the first vertical column and the first horizontal beam.

8. The building system of claim 7, further comprising a second vertical column, wherein the brace comprises a cross brace that couples the first vertical column to the second vertical column.

9. The building system of claim 7, wherein the collar comprises metal, wood, or a composite material.

10. The building system of claim 7, wherein the flange extends a greater distance from the collar on one side of the collar than on another side of the collar.

11. The building system of claim 7, wherein the flange includes a second opening that is sized to receive a fastener to couple the flange to the second horizontal beam.

12. The building system of claim 7, wherein the second horizontal beam comprises a C-channel.

13. The building system of claim 7, wherein the first horizontal beam comprises an I-beam.

14. The building system of claim 7, wherein the flange is further operable to be coupled to a third horizontal beam.

15. A method in a building system, the method comprising:

transmitting a lateral load received at a diaphragm of the building system to an edge of the diaphragm, wherein the building system further includes:

a first vertical column;

a collar with a first opening that runs horizontally through the collar to receive a first horizontal beam, wherein the first opening is sized to enclose at least a portion of a perimeter of the first horizontal beam, and wherein an end of the first horizontal beam passes horizontally through the first opening and is attached to the first vertical column;

a flange around at least a portion of a perimeter of the collar, wherein the flange is operable to be coupled to a second horizontal beam, and wherein the flange is positioned perpendicular to the first horizontal beam;

a first interface to couple the edge of the diaphragm to the second horizontal beam;

a second interface to couple the first vertical column to the end of the first horizontal beam; and a brace coupled to the first vertical column and to the first horizontal beam;

transmitting the lateral load from the edge of the diaphragm to the second horizontal beam via the first interface that couples the edge of the diaphragm to the second horizontal beam;

transmitting the lateral load along the second horizontal beam to an end of the second horizontal beam;

transmitting the lateral load from the end of the second horizontal beam to the collar coupled to the second horizontal beam;

transmitting the lateral load from the collar to the first horizontal beam;

transmitting the lateral load from the first horizontal beam to the first vertical column via the second interface that couples the first horizontal beam to the first vertical column; and transmitting the lateral load from the first vertical column to the brace coupled to the first vertical column and to the first horizontal beam, wherein the brace is operable to absorb at least a portion of the lateral load from at least one of the first vertical column and the first horizontal beam.

16. The method of claim 15, wherein the first interface includes a first plurality of plates coupled to the edge of the diaphragm and a second plurality of plates coupled to the first second horizontal beam, and wherein each plate of the first plurality of plates is coupled to a corresponding plate of the second plurality of plates.

17. The method of claim 15, wherein the second interface includes a plate coupled to the first vertical column and to the first horizontal beam.

* * * * *